US007026999B2

(12) United States Patent
Umehara et al.

(10) Patent No.: US 7,026,999 B2
(45) Date of Patent: Apr. 11, 2006

(54) PATTERN ANTENNA

(75) Inventors: Naoko Umehara, Takatsuki (JP); Hisamatsu Nakano, Kodaira (JP)

(73) Assignees: Sharp Kabushiki Kaisha, Osaka (JP); Hisamatsu Nakano, Kodaira (JP)

( * ) Notice: Subject to any disclaimer, the term of this patent is extended or adjusted under 35 U.S.C. 154(b) by 173 days.

(21) Appl. No.: 10/724,729

(22) Filed: Dec. 2, 2003

(65) Prior Publication Data

US 2004/0108957 A1 Jun. 10, 2004

(30) Foreign Application Priority Data

Dec. 6, 2002 (JP) ..... 2002-355136
Sep. 16, 2003 (JP) ..... 2003-323047

(51) Int. Cl.
*H01Q 1/24* (2006.01)

(52) U.S. Cl. ..... 343/702; 343/700 MS; 343/815

(58) Field of Classification Search ..... 343/700 MS, 343/702, 725, 815, 817, 846
See application file for complete search history.

(56) References Cited

U.S. PATENT DOCUMENTS 6,686,886 B1 * 2/2004 Flint et al. ..... 343/702
2005/0110692 A1 * 5/2005 Andersson ..... 343/702

FOREIGN PATENT DOCUMENTS

JP 2002-185238 A 6/2002
JP 2000-68736 A 3/2003

* cited by examiner

*Primary Examiner*—Shih-Chao Chen
(74) *Attorney, Agent, or Firm*—Birch, Stewart, Kolasch & Birch, LLP

(57) ABSTRACT

A printed circuit board has an inverted-L-shaped antenna pattern, which is provided with a conductor pattern connected to a ground pattern, so formed thereon as to be in close proximity to the outside of an inverted-F-shaped antenna pattern which is provided with a conductor pattern connected to a feeding point and with a conductor pattern connected to a ground pattern. By making resonance frequency of each of the inverted-F-shaped antenna pattern and the inverted-L-shaped antenna pattern different, it is possible to compose a frequency antenna using different frequency bands.

100 Claims, 19 Drawing Sheets

FIG.15
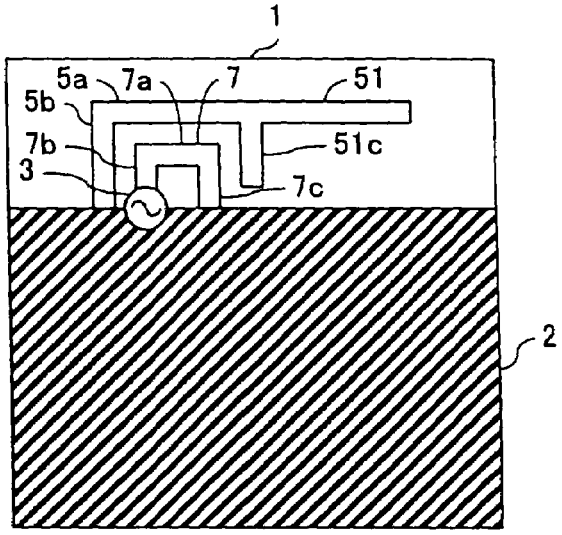
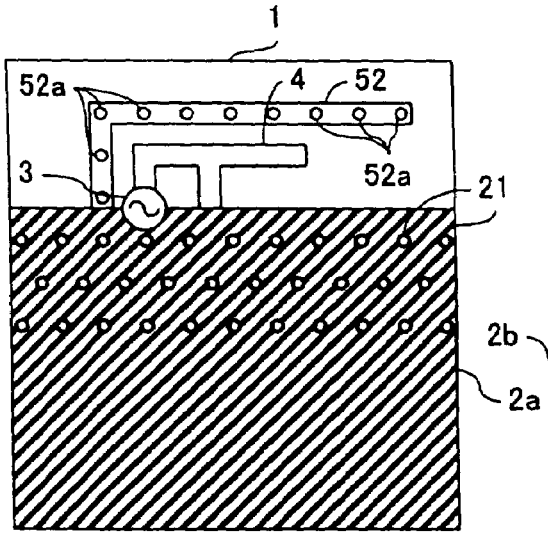
Fig.16A
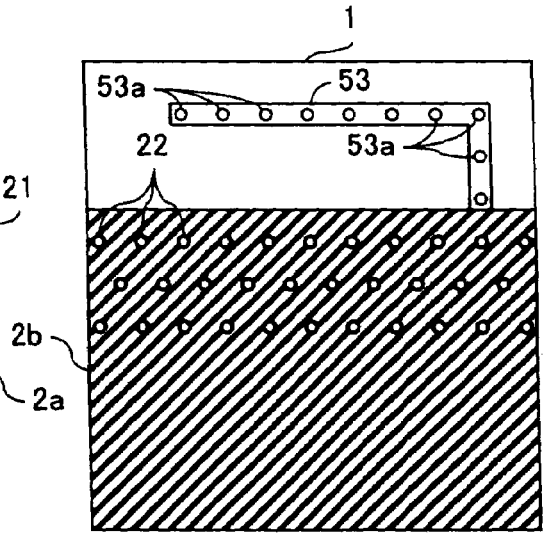
Fig.16B

PATTERN ANTENNA

CROSS REFERENCE TO RELATED APPLICATIONS

This application is based on Patent Application No. 2002-355136 filed in Japan on Dec. 6, 2002 and Patent Application No. 2003-323047 filed in Japan on Sep. 16, 2003, the contents of which are incorporated hereinto by reference.

BACKGROUND OF THE INVENTION

1. Field of the Invention

The present invention relates to a pattern antenna to be used for a wireless communication device. The present invention relates particularly to a pattern antenna for a wireless communication equipment which uses more than two frequencies.

2. Description of the Prior Art

It is conventional to use a wireless communication equipment which deals with more than two frequency bands. Systems used for such a wireless communication equipment include Frequency Division Multiple Access (FDMA) method utilizing Frequency Division Duplex (FDD) method in which separate frequency bandwidths are used for transmission and reception; and Time Division Multiple Access (TDMA) method and Code Division Multiple Access (CDMA) method that utilize the FDD method and Time Division Duplex (TDD) method in which time is separated by transmission and reception.

In wireless communication equipment, and in portable wireless communication devices in particular, in order to miniaturize the devices, it is required to miniaturize an antenna to be put into a casing of the wireless communication equipment. In order to miniaturize the antenna, inverted-F-shaped antennas are widely utilized. However, since the frequency bandwidth of the inverted-F-shaped antennas is several percentages in the bandwidth to center frequency ratio, and additionally, due to miniaturization, the frequency bandwidth of the antennas becomes narrow. As a result, as mentioned above, in wireless communication equipment utilizing systems which use more than two wireless frequency bands, the antennas cannot cover a wide frequency bandwidth which contains more than two necessary wireless frequency bands.

As a conventional technique to solve the above-mentioned problem, Japanese Patent Application Laid-Open No. 2000-68736 proposes a multi-frequency antenna consisting of an inverted-F type antenna, wherein a radiation conductor board which is in parallel with a grounding conductor board and to which electrical energy is fed through a coaxial cable has a plurality of unit radiation conductor boards of different length mounted thereon. As another conventional technique, Japanese Patent Application Laid-Open No. 2002-185238 proposes a built-in antenna device corresponding to dual band constituting of a plurality of planar radiation conductors of different length which are in parallel with a planar ground and to which electrical energy is fed by way of a feeding pin.

However, these conventional methods described in Japanese Patent Application Laid-Open Nos. 2000-68736 and 2002-185238, first of all, require a specific amount of space between the radiation conductor board and the ground surface and thus limit miniaturization and thinning of the antennas. In addition, in an aspect of production, a metal mold is necessary for cutting out of a conductor board. Therefore, whenever it is necessary to change the layout of components surrounding the antenna and/or a casing covering the antenna, it is necessary to change the shape of an antenna element, thus requiring a metal mold to be newly made or changed. Also, in order to support the radiation conductor board, it is necessary to insert a spacer between the ground board and the radiation conductor board or to bond a radiation conductor board to the inside of a non-electroconductive casing. Furthermore, in order to feed electrical energy to the radiation conductor board, a feeding pin is necessary to connect the radiation conductor board to the feeding point in an appropriate manner, and thereby it is a trouble and takes time to assemble these components.

SUMMARY OF THE INVENTION

An object of the present invention is to provide a pattern antenna which deals with more than two frequency bands and can be miniaturized.

Another object of the present invention is to provide a pattern antenna which deals with a wide frequency bandwidth including more than two frequency bands and can be miniaturized.

In order to achieve the above objects, according to one aspect of the present invention, a pattern antenna is provided with:

a first antenna pattern functioning as a driven element, that includes an elongate pattern which is approximately in parallel with an edge of circumference of a grounding conductor portion mounted on a circuit board and a feeding pattern which connects a feeding point mounted on the circuit board to the elongate pattern;

a second antenna pattern functioning as a passive element, that is so formed as to be in close proximity to the first antenna pattern and to surround the first antenna pattern and includes an elongate pattern which is approximately in parallel with the edge of circumference of the grounding conductor portion and a grounding pattern which connects the grounding conductor portion to the elongate pattern;

wherein the pattern antenna is mounted on the circuit board.

According to another aspect of the present invention, a pattern antenna is provided with:

a first antenna pattern functioning as a passive element, that includes an elongate pattern which is approximately in parallel with an edge of circumference of a grounding conductor portion mounted on a circuit board and a grounding pattern which connects the grounding conductor portion to the elongate pattern;

a second antenna pattern functioning as a driven element that is formed to be in close proximity to the first antenna pattern and to surround the first antenna pattern and includes an elongate pattern which is approximately in parallel with the edge of circumference of the grounding conductor portion and a feeding pattern which connects a feeding point mounted on the circuit board to the elongate pattern;

wherein the pattern antenna is mounted on the circuit board.

According to another aspect of the present invention, a pattern antenna is provided with:

a first antenna pattern formed as loop-type antenna pattern, comprising an elongate pattern which is approximately in parallel with an edge of circumference of a grounding conductor portion mounted on a circuit board; a feeding pattern which connects a feeding point mounted on the circuit board and the elongate pattern; and a grounding pattern which connects the grounding conductor portion to the elongate pattern;

a second antenna pattern that is an inverted-L-shaped antenna pattern, comprising an elongate pattern which is approximately in parallel with the edge of circumference the grounding conductor portion; and a grounding pattern which connects the grounding conductor portion to the elongate pattern;

wherein the circuit board is provided with a plurality of layers including a surface of the circuit board; and wherein the first antenna pattern and the second antenna pattern are formed on different layers and the first antenna pattern and the second antenna pattern are so formed as to overlap each other.

As mentioned above, according to the present invention, by using more than two antenna patterns which are in close proximity to each other, a feeding point can be set to be one, so that it is not necessary to change over the antennas according to a usable frequency band. Additionally, since pattern antennas are constituted of only copper foil formed on the printed circuit, they can be miniaturized and thinned and do not require components such as conductor boards, feeding pins and the like that have been required conventionally. As a result, it is not necessary to make a metal mold for manufacturing these components, thus enhancing productivity. In addition, since the pattern antennas themselves are not in solid shape, they do not need components which support conductor boards serving as radiation boards that have been required conventionally. Furthermore, by forming a plurality of antenna patterns to be in close proximity to each other, it is possible to realize frequency pattern antennas, sharing a wide range of frequency.

Moreover, according to the present invention, by constituting of antenna patterns that are different in path length, it is possible to configure the pattern antennas to be equipped with a plurality of usable frequency bandwidths. Furthermore, according to the present invention, it is possible to have the pattern antennas equipped with a wide frequency bandwidth, wherein the bandwidth to center frequency ratio is more than 100% when the voltage standing wave ratio (VSWR) is 2.0 or less (VSWR≦2.0).

DESCRIPTION OF THE DRAWINGS

FIG. 15 is a plan view showing another configuration of the pattern antenna of the fifth embodiment of the invention;

FIG. 16A and FIG. 16B are diagrams showing the configurations of the pattern antenna of a sixth embodiment of the invention;

FIG. 17A and FIG. 17B are diagrams showing the configurations of the pattern antenna of a seventh embodiment of the invention;

DESCRIPTION OF THE INVENTION

Hereinafter, embodiments of the present invention will be described.

<First Embodiment>

Figure 1:
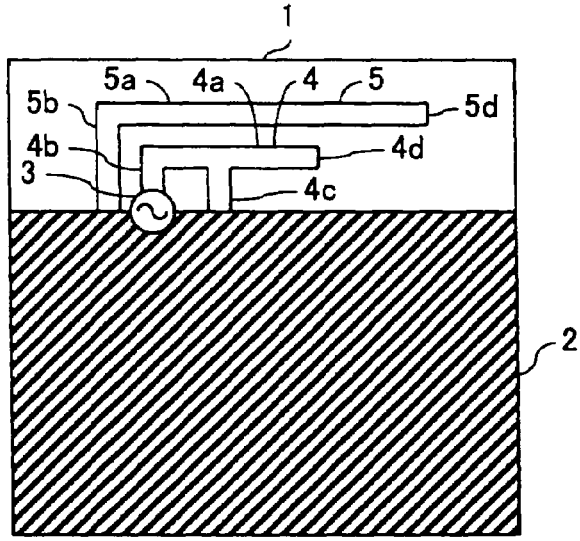
FIG. 1 is a plan view showing one configuration of the pattern antenna of a first embodiment of the invention.
Figure 2:
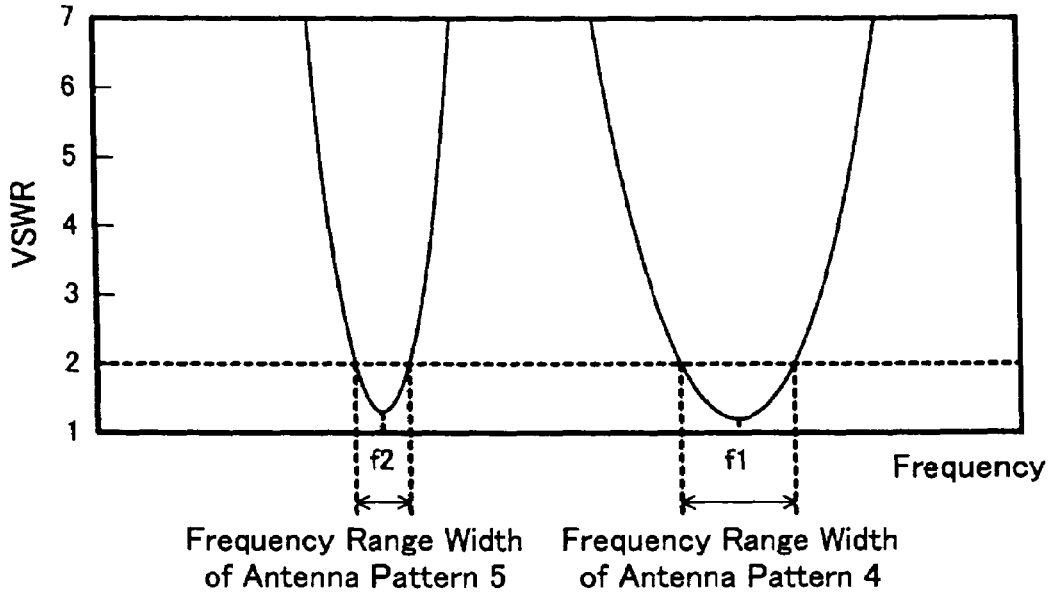
FIG. 2 is a graphic chart showing the frequency response of the voltage standing wave ratio (VSWR) of the pattern antenna of FIG. 1.

A first embodiment of the present invention will be described below with reference to the drawings. FIG. 1 is a diagram showing the obverse-side surface of the pattern antenna of this embodiment. FIG. 2 is a graph showing the frequency response of the voltage standing wave ratio (VSWR) of the pattern antenna of this embodiment.

The pattern antenna of this embodiment is composed of an inverted-F-shaped antenna pattern 4 and an inverted-L-shaped antenna pattern 5 that are formed by a metal foil on the surface of a printed circuit board 1 shown in FIG. 1; and a ground pattern 2. The inverted-F-shaped antenna pattern 4 and the inverted-L-shaped antenna pattern 5 are formed in an edge portion of the printed circuit board 1 which has other circuit patterns and the like also formed thereon.

The inverted-F-shaped antenna pattern 4 formed on the surface of the printed circuit board 1 consists of an elongate pattern 4*a* that is formed in parallel with the edge of circumference of the ground pattern 2 facing to it; a conductor pattern 4*b* that is connected at one end to the end of the elongate 4*a* opposite to the open end 4*d* thereof and is connected at the other end to a feeding point 3 installed to the edge of circumference of the ground pattern 2; and a conductor pattern 4*c* that is connected at one end to one point between the open end 4*d* of the elongate pattern 4*a* and the conductor pattern 4*b* and is also connected at the other end to the ground pattern 2.

The inverted-L-shaped antenna pattern 5, which is formed on the surface of the printed circuit board 1 in the same manner as the inverted-F-shaped antenna pattern 4, consists of an elongate pattern 5*a* that is formed to be in close proximity to the elongate pattern 4*a* and in parallel with the edge of circumference of the ground pattern 2 facing to it; and a conductor pattern 5*b* that is in close proximity to the conductor pattern 4*b* and is connected at one end to the opposite side of an open end 5*d* of the elongate pattern 5*a* and is also connected at the other end to the ground pattern 2. As a result, the inverted-L-shaped antenna pattern 5 is so formed as to surround the outside of the inverted-F-shaped antenna pattern 4.

The inverted-F-shaped antenna pattern 4 configured in this way resonates, acting as a driven element to which electrical energy is fed, and the inverted-L-shaped antenna pattern 5 resonates, acting as a passive element excited by the inverted-F-shaped antenna pattern 4 which acts as a driven element. Here, by making an addition of the lengths of the elongate pattern 4*a* and the conductor pattern 4*b* of the inverted-F-shaped antenna pattern 4 different from an addition of the lengths of the elongate pattern 5*a* and the conductor pattern 5*b* of the inverted-L-shaped antenna pattern, frequencies at which each of the antenna patterns resonates are set to be different.

Here, when frequencies for reception are f1 and f2 and wavelengths corresponding to the frequencies f1 and f2 are λ1 and λ2, then a path length L1 of the inverted-F-shaped antenna pattern 4 which equals to the addition of the length of the elongate pattern 4*a* and the length of the conductor pattern 4*b* is set to be 10% to 40% of the wavelength λ1, and a path length L2 of the inverted-L-shaped antenna pattern 5 which equals to the addition of the length of the elongate pattern 5*a* and that of the conductor pattern 5*b* is set to be 10% to 40% of the wavelength λ2.

By determining the path lengths L1 and L2 of the inverted-F-shaped antenna pattern 4 and the inverted-L-shaped antenna pattern 5 respectively in this manner, usable frequency bandwidth are so formed as to correspond to each of the path lengths of the inverted-F-shaped antenna pattern 4 and the inverted-L-shaped antenna pattern 5. As a result, since the frequency response of the voltage standing wave ratio (VSWR) of the pattern antenna configured as in FIG. 1 is to be as shown in FIG. 2 and the VSWR at the frequencies near the frequencies f1 and f2 is to be lower than 2, the antenna response at the frequencies f1 and f2 become favorable and can compose a frequency pattern antenna. Additionally, in the inverted-F-shaped antenna pattern 4, impedance can be adjusted by adjusting the location of the conductor pattern 4*c*.

For the above-mentioned wavelengths λ1 and λ2, contraction of the wavelengths due to dielectric constant of the printed circuit board 1 is taken into consideration. In other words, when the wavelength in the air is λair, the wavelength λp on the surface of the printed circuit board 1 is $\lambda p=\lambda air/((\in r+1)/2)^{1/2}$, and the wavelength λpin inside the printed circuit board 1 is $\lambda p=\lambda air/(\in r)^{1/2}$. The value ∈r indicates relative dielectric constant of the printed circuit board 1.

Figure 3:
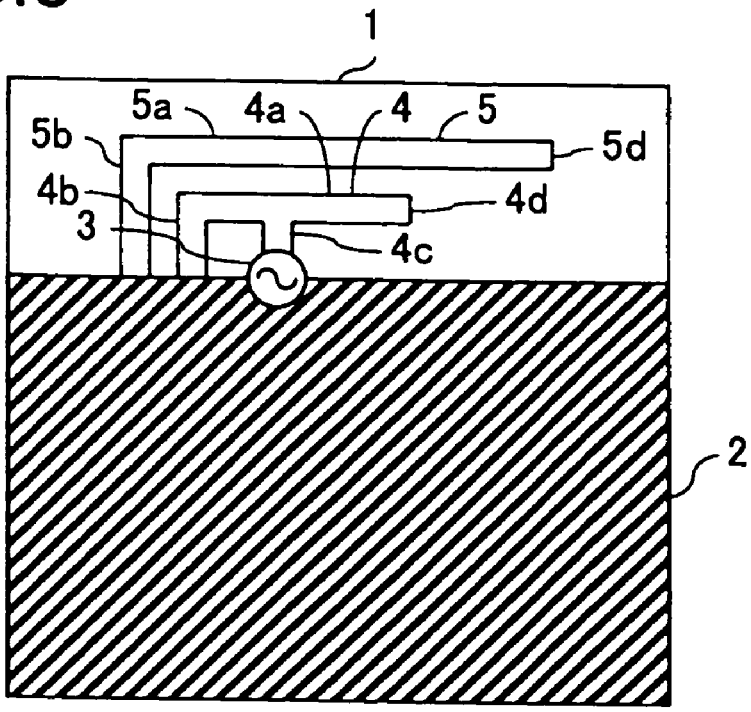
FIG. 3 is a plan view showing another configuration of the pattern antenna of the first embodiment of the invention.
Figure 4:
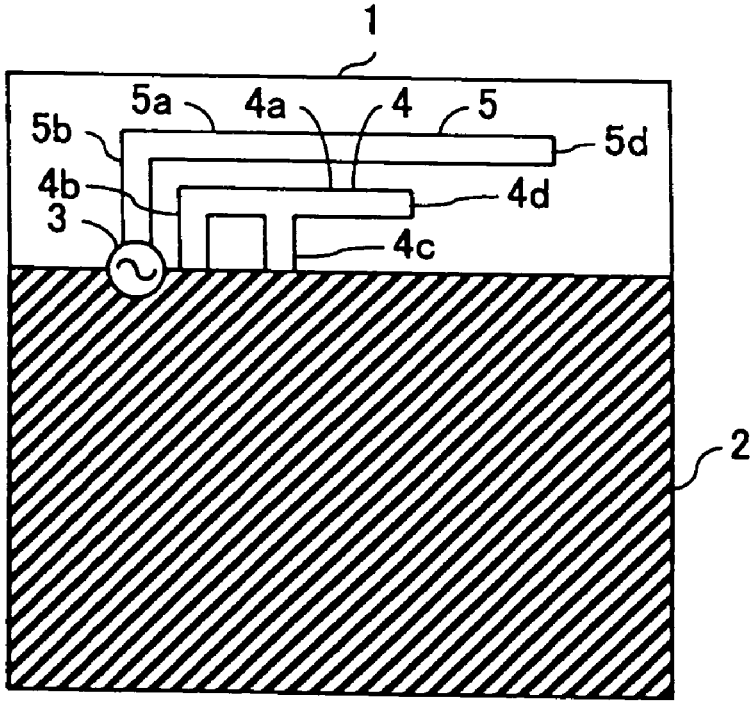
FIG. 4 is a plan view showing another configuration of the pattern antenna of the first embodiment of the invention.

Other constructions of this embodiment are shown in FIGS. 3 and 4. The pattern antennas indicated in these FIGS. 3 and 4 are composed of the inverted-F-shaped antenna pattern 4 and the inverted-L-shaped antenna pattern 5; and the ground pattern 2 in the same manner as the pattern antenna indicated in FIG. 1. However, in the pattern antenna shown in FIG. 3, different from the pattern antenna shown in FIG. 1, the ground pattern 2 is connected to the conductor pattern 4*b* of the inverted-F-shaped antenna pattern 4 and also the feeding point 3 is connected to the conductor pattern 4*c*.

In the pattern antenna shown in FIG. 4, both the conductor patterns 4*b* and 4*c* of the inverted-F-shaped antenna pattern 4 are connected to the ground pattern 2, and the feeding point 3 is connected to the conductor pattern 5*b* of the inverted-L-shaped antenna pattern 5. Moreover, in the inverted-F-shaped antenna pattern 4, when it is constructed as shown in FIGS. 3 and 4, impedance can be adjusted by adjusting the position of the conductor pattern 4*c*.

<Second Embodiment>

Figure 5:
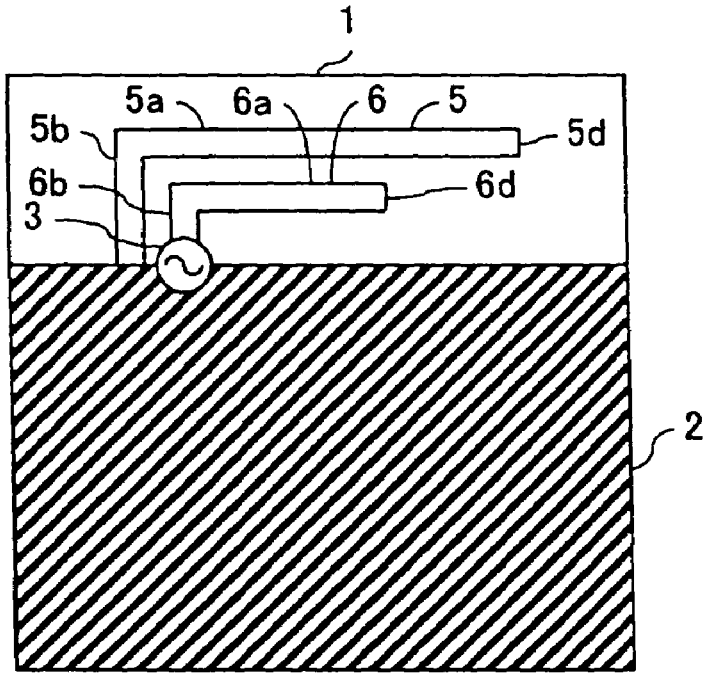
FIG. 5 is a plan view showing one configuration of the pattern antenna of a second embodiment of the invention.

A second embodiment of the invention will be described below with reference to the drawings. FIG. 5 is a diagram showing the obverse-side surface of the pattern antenna of this embodiment. Here, such elements as are used for the same purposes as in the pattern antenna of the first embodiment are identified with the same reference numerals, and their detailed explanations will not be repeated.

The pattern antenna of this embodiment is composed of the inverted-L-shaped antenna patterns 5 and 6 formed by metal foils on the surface of the printed circuit board 1 shown in FIG. 5 and the ground pattern 2. Here, the inverted-L-shaped antenna pattern 6 is formed approximately at the same location of the inverted-F-shaped antenna pattern 4 in FIG. 1, namely, at the location where it is surrounded by the inverted-L-shaped antenna pattern 5. Moreover, the inverted-L-shaped antenna pattern 6 is composed of an elongate pattern 6*a* which is formed to be in close proximity to the elongate pattern 5*a* and in parallel with an edge of circumference of the ground pattern 2 facing to it; and a conductor pattern 6*b* which is in close proximity to the conductor pattern 5*b* and is connected to an edge opposite to an open end 6*d* of the elongate pattern 6*a* at one end and connected to the feeding point 3 at the other end.

The inverted-L-shaped antenna pattern 6 formed in this way resonates, acting as a driven element to which electrical energy is fed; and the inverted-L-shaped antenna pattern 5 resonates, acting as a passive element that is exited by the inverted-L-shaped antenna pattern 6 which serves as the driven element. At this time, an addition L1 of each length of the elongate pattern 6*a* and the conductor pattern 6*b* of the inverted-L-shaped antenna pattern 6 and an addition L2 of each length of the elongate pattern 5*a* and the conductor pattern 5*b* of the inverted-L-shaped antenna pattern 5 can be set in a manner that the frequencies at which each of the antenna patterns 5 and 6 resonates are f1 and f2, with the wavelengths λ1 and λ2 being 10 to 40%.

By determining the path lengths L1 and L2 of the inverted-L-shaped antenna patterns 6 and 5 respectively, usable frequency bandwidths are formed to correspond to each path length of the inverted-L-shaped antenna patterns 6 and 5. As a result, as in the first embodiment of the invention, since the frequency response of the voltage standing wave ratio of the pattern antenna configured as in FIG. 5, is to be as such as the VSWR of the frequencies around the frequencies f1 and f2 is lower than 2, the antenna response at the frequencies f1 and f2 becomes favorable and a frequency pattern antenna can be composed.

Figure 6:
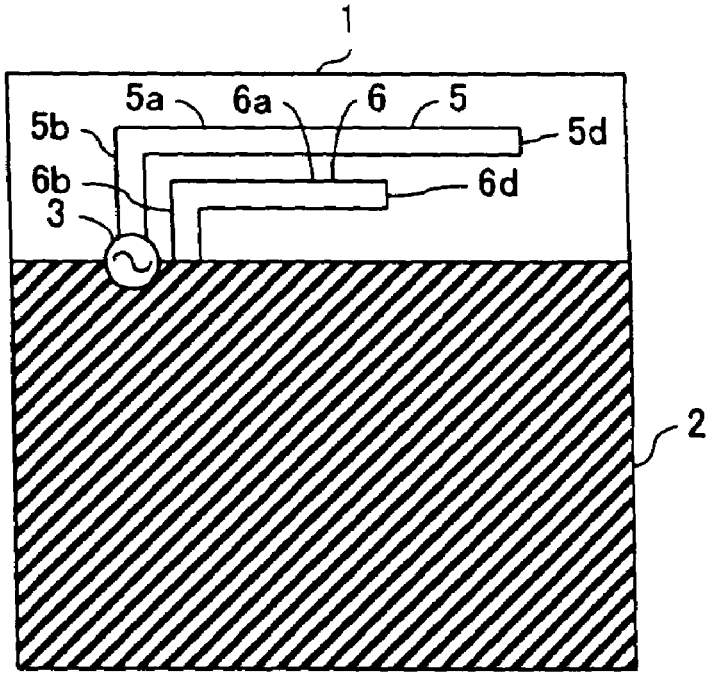
FIG. 6 is a plan view showing another configuration of the pattern antenna of the second embodiment of the invention.

Another construction of this embodiment is shown in FIG. 6. The pattern antenna shown in FIG. 6, as in the pattern antenna shown in FIG. 5, is composed of the inverted-L-shaped antenna patterns 5 and 6 and the ground pattern 2. However, different from the pattern antenna shown in FIG. 5, in the pattern antenna shown in FIG. 6, the conductor pattern 6*b* of the inverted-L-shaped antenna pattern 6 is connected to the ground pattern 2 and the feeding point 3 is connected to the conductor pattern 5*b* of the inverted-L-shaped antenna pattern 5.

<Third Embodiment>

Figure 7:
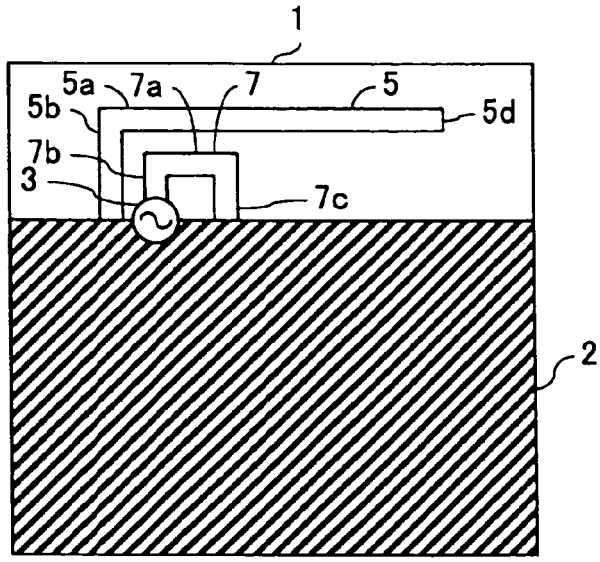
FIG. 7 is a plan view showing one configuration of the pattern antenna of a third embodiment of the invention.

A third embodiment of the present invention will be described below with reference to the drawings. FIG. 7 is a diagram showing the obverse-side of the pattern antenna of this embodiment. Here, such elements as are used for the same purposes as in the pattern antenna of the first embodiment are identified with the same reference numerals, and their detailed explanations will not be repeated.

The pattern antenna of this embodiment is composed of the inverted-L-shaped antenna pattern 5 and a loop-type antenna pattern 7 that are formed by a metal foil on a surface of the printed circuit board 1 shown in FIG. 7; and the ground pattern 2. Here, the loop-type antenna pattern 7 is formed approximately at the same location as the inverted-F-shaped antenna pattern 4 in FIG. 1, namely, at the position where it is surrounded by the inverted-L-shaped antenna pattern 5.

The loop-type antenna pattern 7 is composed of an elongate pattern 7*a* which is formed to be in close proximity to the elongate pattern 5*a* and also in parallel with an edge of circumference of the ground pattern 2 facing to it; a conductor pattern 7*b* which is in close proximity to the conductor pattern 5*b* and is connected to an edge of the elongate pattern 7*a* at one end and to the feeding point 3 at the other end; and a conductor pattern 7*c* which is connected to the other edge of the elongate pattern 7*a* at one end and to the ground pattern 2 at the other end, thus forming a loop together with the ground pattern 2.

The loop-type antenna pattern 7 formed in this way resonates, acting as a driven element to which electrical energy is fed, and the inverted-L-shaped antenna pattern 5 resonates, acting as a passive element which is excited by the loop-type antenna pattern 7 serving as a driven element. Here, the path lengths of the antenna patterns 5 and 7 are set in a manner that the resonance frequencies of each of the loop-type antenna pattern 7 and the inverted-L-shaped antenna pattern 5 are f1 and f2. As a result, as in the first embodiment, in the frequency response of the voltage standing wave ratio of the pattern antenna configured as shown in FIG. 7, the VSWR of the frequencies around f1 and f2 are lower than 2, and a frequency pattern antenna can be composed.

Figure 8:
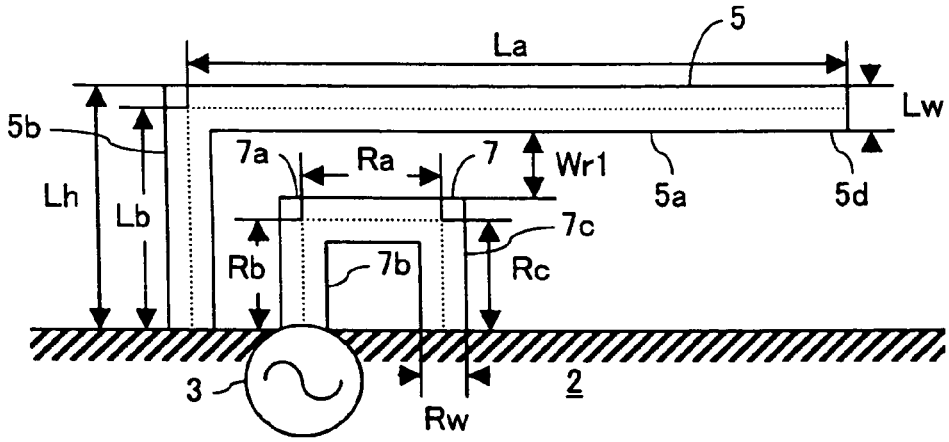
FIG. 8 is a diagram showing the numerical relationship between patterns constituting the pattern antenna of the third embodiment of the invention.

Furthermore, in this embodiment, as shown in FIG. 8, by setting each value of the lengths La and Lb of the elongate pattern 5*a* and the conductor pattern 5*b*, the conductor width Lw of the inverted-L-shaped antenna pattern 5, the height Lh of the inverted-L-shaped antenna pattern 5, the lengths Ra, Rb and Rc of the elongate pattern 7*a* and the conductor patterns 7*b* and 7*c*, the conductor width Rw of the loop-type antenna pattern 7, and the space Wr1 between the inverted-L-shaped antenna pattern 5 and the loop-type antenna pattern 7 respectively, the usable frequency bandwidth can be widened.

The relation between the values will be described below, by setting the center frequency of usable frequency bandwidth to be f0 and setting the relative dielectric constant of the printed circuit board 1 to be 4.2. Here, the length La of the elongate pattern 5*a* represents the length from the open end 5*d* to the center of the conductor pattern 5*b*; the length Lb of the conductor pattern 5*b* represents the length between the connection point to the ground pattern 2 and the center of the elongate pattern 5*a*; the length Ra of the elongate pattern 7*a* represents the length between the centers of the conductor patterns 7*b* and 7*c*; and the lengths Rb and Rc of the conductor patterns 7*b* and 7*c* represent the length from each of the feeding point 3 and the connection point to the ground pattern 2 to the center of the elongate pattern 7*a* respectively. In other words, the lengths La, Ra, Lb, Rb and Rc represent the lengths in the center of each of the elongate patterns 5*a* and 7*a* and the conductor patterns 5*b*, 7*b* and 7*c* respectively.

Moreover, the height Lh of the inverted-L-shaped antenna pattern 5 represents the length between the connection point to the ground pattern 2 and the outer edge of the elongate pattern 5*a*; and the space Wr1 between the inverted-L-shaped antenna pattern 5 and the loop-type antenna pattern 7 represents the length from the inner edge of the inverted-L-shaped antenna pattern 5 to the outer edge of the loop-type antenna pattern 7. Furthermore, the wavelength corresponding to the center frequency f0 in the usable frequency bandwidth is set as λ0.

First, in the inverted-L-shaped antenna pattern 5, an addition La+Lb of the lengths La and Lb of the elongate pattern 5*a* and the conductor pattern 5*b* is set to be 0.4λ0 to 0.7λ0; and in the loop-type antenna pattern 7, an addition of Ra+Rb+Rc of the lengths Ra, Rb and Rc of the elongate pattern 7*a* and the conductor patterns 7*b* and 7*c* are set to be 0.3λ0 to 0.5 λ0. Then, the conductor width Lw of the inverted-L-shaped antenna pattern 5 is set to be 0.005λ0 to 0.15λ0, and the conductor width Rw of the loop-type antenna pattern 7 is set to be 0.005λ0 to 0.05λ0. Furthermore, the space Wr1 between the inverted-L-shaped antenna pattern 5 and the loop-type antenna pattern 7 is set to be 0.002λ0 to 0.04λ0, and the height Lh of the inverted-L-shaped antenna pattern 5 is set to be 0.1λ0 to 0.3λ0.

Figure 9:
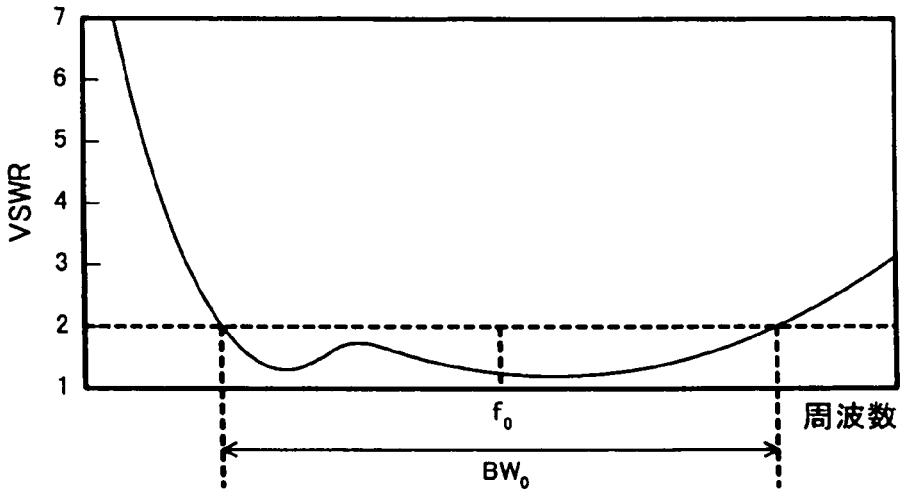
FIG. 9 is a graphic chart showing the frequency response of the voltage standing wave ratio (VSWR) of the pattern antenna of FIG. 8.

The frequency response of the voltage standing wave ratio of the pattern antenna with each of the values set in the above-mentioned way is as shown in FIG. 9, and the frequency bandwidth where the VSWR is lower than 2 is so formed as to spread with the center frequency f0 in the center. It is possible to make the bandwidth BW0 of the frequency bandwidth where the VSWR is lower than 2 wider and make the bandwidth to center frequency ratio BW0 versus f0 (BW0/f0) more than 100%.

Here, for example, when the center frequency of the usable frequency bandwidth is assumed to be 7 GHz, the length La+Lb of the inverted-L-shaped antenna pattern 5 and the conductor width Lw are assumed to be 17 mm and 2 mm respectively; the length Ra+Rb+Rc of the loop-type antenna pattern 7 and the conductor width Rw are assumed to be 11 mm and 0.7 mm respectively; the space Wr1 between the inverted-L-shaped antenna pattern 5 and the loop-type antenna pattern 7 is assumed to be 0.2 mm; and the height Lh of the inverted-L-shaped antenna pattern 5 is assumed to be 6 mm. By setting these values in this way, in the VSWR response in FIG. 9, the center frequency f0 is 7 GHz; the bandwidth BW0 is 8 GHz; and the bandwidth to center frequency ratio BW0/f0 is 114%. As a result, the ratio more than 100% is achieved.

Figure 10:
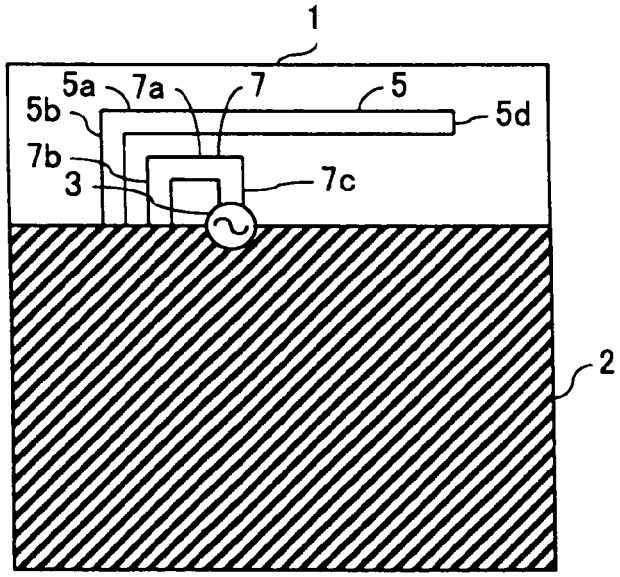
FIG. 10 is a plan view showing another configuration of the pattern antenna of the third embodiment of the invention.
Figure 11:
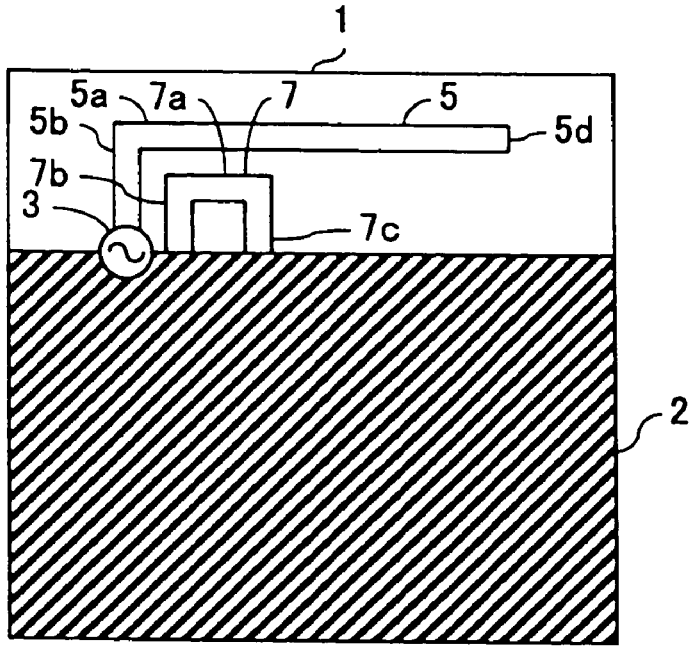
FIG. 11 is a plan view showing another configuration of the pattern antenna of the third embodiment of the invention.

Other structures of this embodiment are shown in FIGS. 10 and 11. As in the pattern antenna shown in FIG. 7, the pattern antennas shown in FIGS. 10 and 11 are composed of the inverted-L-shaped antenna pattern 5 and the loop-type antenna pattern 7; and the ground pattern 2. However, different from the pattern antenna shown in FIG. 7, in the pattern antenna shown in FIG. 10, the ground pattern 2 is connected to the conductor pattern 7*b* of the loop-type antenna pattern 7 and also the feeding point 3 is connected to the conductor pattern 7*c*. Moreover, different from the pattern antenna shown in FIG. 7, in the pattern antenna shown in FIG. 11, both the conductor patterns 7*b* and 7*c* of the loop-type antenna pattern 7 are connected to the ground pattern 2, and the feeding point 3 is connected to the conductor pattern 5*b* of the inverted-L-shaped antenna pattern 5.

<Fourth Embodiment>

Figure 12:
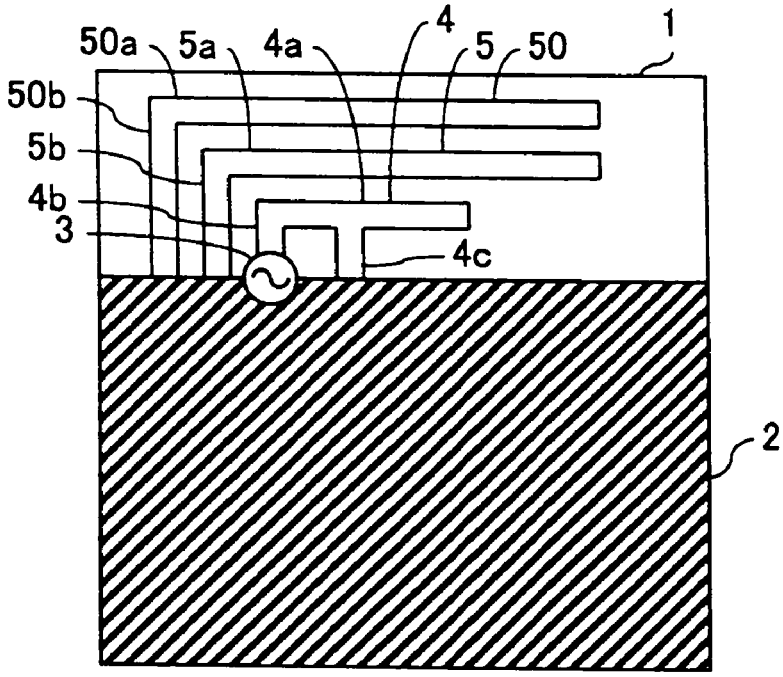
FIG. 12 is a plan view showing one configuration of the pattern antenna of a fourth embodiment of the invention.

A fourth embodiment of the present invention will be described below with reference to the drawings. FIG. 12 is a diagram showing the obverse-side surface of the pattern antenna of this embodiment. Here, such elements as are used for the same purposes as in the pattern antenna of the first embodiment are identified with the same reference numerals, and their detailed explanations will not be repeated.

The pattern antenna of this embodiment is composed of the inverted-F-shaped antenna pattern 4 and the inverted-L-shaped antenna patterns 5 and 50 that are formed by a metal foil on a surface of a printed circuit board 1 shown in FIG. 12; and the ground pattern 2. Also, the inverted-L-shaped antenna pattern 50 is constructed in the same manner as the inverted-L-shaped antenna pattern 5; is equipped with an elongate pattern 50*a* in close proximity to the elongate pattern 5*a* and with a conductor pattern 50*b* in close proximity to the conductor pattern 5*b*; and is formed outside the inverted-L-shaped antenna pattern 5.

Here, by making the path lengths of the inverted-L-shaped antenna patterns 5 and 50 approximately the same, the resonance frequencies of the inverted-L-shaped antenna patterns 5 and 50 can be made approximately the same. By having the inverted-L-shaped antenna patterns 5 and 50, which act as passive elements and whose path lengths are approximately the same, formed to be in close proximity to each other in this way, the frequency bandwidth of the inverted-L-shaped antenna patterns 5 and 50 can be widened, compared with when constructed as in FIG. 1.

Figure 13:
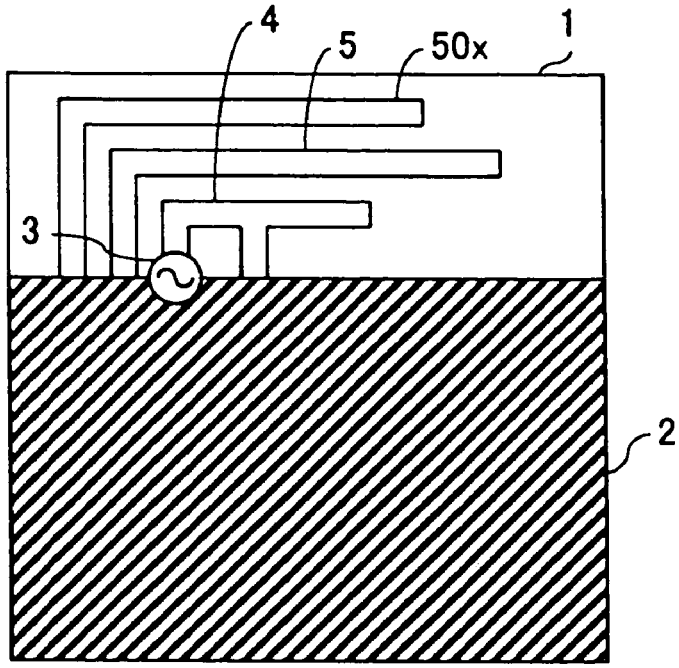
FIG. 13 is a plan view showing another configuration of the pattern antenna of the fourth embodiment of the invention.

Moreover, this embodiment is so configured as to have another inverted-L-shaped antenna pattern 50, whose path length is approximately the same as that of the inverted-L-shaped antenna pattern 5, added to a pattern antenna shown in FIG. 1. For example, as shown in FIG. 13, a pattern antenna shown in FIG. 1 may have an inverted-L-shaped antenna pattern 50*x* whose path length is different from that of the inverted-F-shaped antenna pattern 4 and also different from the path length of the inverted-L-shaped antenna pattern 5 added thereto. In this way, it is possible to constitute a frequency antenna for three usable frequencies.

The pattern antenna of this embodiment may not have an inverted-L-shaped pattern antenna added thereto, but may have more than two inverted-L-shaped pattern antennas added thereto. Here, by making the path lengths of the pattern antennas constituting a laminate antenna pattern different from each other, it is possible to construct a frequency antenna, sharing the same number of usable frequencies as the number of the pattern antennas. Furthermore, it may be possible to have an inverted-L-shaped pattern antenna added to any of the pattern antennas in FIG. 1 or FIGS. 3 through 7, FIG. 10 or FIG. 11.

<Fifth Embodiment>

Figure 14:
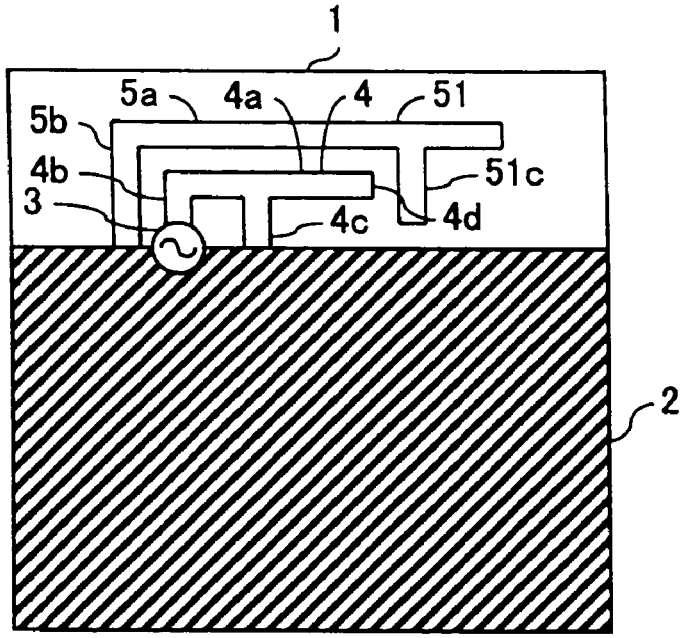
FIG. 14 is a plan view showing one configuration of the pattern antenna of a fifth embodiment of the invention.

A fifth embodiment of the invention will be described below with reference to the drawings. FIG. 14 is a diagram showing the obverse-side surface of the pattern antenna of this embodiment. Here, such elements as are used for the same purposes as in the pattern antenna of the first embodiment are identified with the same reference numerals, and their detailed explanations will not be repeated.

The pattern antenna of this embodiment is composed of the inverted-F-shaped antenna pattern 4 and an inverted-L-shaped antenna pattern 51 that are formed by a metal foil on a surface of the printed circuit board 1 shown in FIG. 14; and the ground pattern 2. Also, the inverted-L-shaped antenna pattern 51 is provided with an elongate pattern 5*a* and a conductor pattern 5*b* in the same manner as the inverted-L-shaped antenna pattern 5 (FIG. 1), wherein a branch-shaped stub pattern 51*c* is formed, starting at one point between both edges of the elongate pattern 5*a*.

Then, the stub pattern 51*c* is so formed as not to overlap the inverted-F-shaped antenna pattern 4 and the ground pattern 2 and so formed as to be in close proximity to the open end 4*d* of the elongate pattern 4*a*. Additionally, the elongate pattern 5*a*, the conductor pattern 5*b* and the stub pattern 51*c* of the inverted-L-shaped antenna pattern 51 are so formed as to surround the inverted-L-shaped antenna pattern 4. By providing a stub pattern 51*c* in this way, impedance can be adjusted for the inverted-L-shaped pattern 51, and in addition, electromagnetic connecting state of the inverted-F-shaped antenna pattern 4 can be adjusted by forming it in close proximity to the inverted-F-shaped antenna pattern 4.

In this embodiment, a stub pattern is so constructed as to be mounted onto an inverted-L-shaped antenna pattern, based on the pattern antenna shown in FIG. 1. For example, an inverted-F-shaped pattern antenna or an inverted-L-shaped pattern antenna or a loop-type pattern antenna that constitutes any of the pattern antennas in FIG. 1 or FIGS. 3 through 7 or FIGS. 10 through 13 may have a stub pattern mounted thereon, so as to be composed of a loop-type antenna pattern 7 and the inverted-L-shaped antenna pattern 51 as in FIG. 15. Also, in this embodiment, an elongate pattern has a stub pattern mounted thereon. However, the conductor pattern may have a stub pattern mounted thereon.

<Sixth Embodiment>

A sixth embodiment of the invention will be described below with reference to the drawings. FIGS. 16A and 16B are diagrams showing the obverse-side surface and the reverse-side surface of the pattern antenna of this embodiment respectively. Here, such elements as are used for the same purposes as in the pattern antenna of the first embodiment are identified with the same reference numerals, and their detailed explanations will not be repeated.

The pattern antenna of this embodiment is composed of an inverted-F-shaped antenna pattern 4, an inverted-L-shaped antenna pattern 52 and a ground pattern 2*a* that are formed by a metal foil on a surface of the printed circuit board 1 shown in FIG. 16A; and an inverted-L-shaped antenna pattern 53 and a ground pattern 2*b* that are formed by a metal foil on the reverse-side surface of the printed circuit board 1 shown in FIG. 16B. Here, the inverted-L-shaped antenna patterns 52 and 53 are so formed as to have the same configuration, and the inverted-L-shaped antenna patterns 52 and 53 and the ground patterns 2*a* and 2*b* are so formed as to overlap each other by way of the printed circuit board 1. Wherein, the inverted-L-shaped antenna patterns 52 and 53 are so formed as to have the same configuration as the inverted-L-shaped antenna pattern 5 in FIG. 1.

The inverted-L-shaped antenna patterns 52 and 53 have a plurality of through holes 52*a* and 53*a* made entirely therein. By way of these through holes 52*a* and 53*a*, the inverted-L-shaped antenna patterns 52 and 53 are electrically connected. Additionally, the ground patterns 2*a* and 2*b* have through holes 21 and 22 made therein, and by way of the through holes 21 and 22 therein, the ground patterns 2*a* and 2*b* are electrically connected. In this way, by connecting a plurality of inverted-L-shaped antenna patterns 52 and 53, which act as passive elements, by way of the through holes 52*a* and 53*a*; and by overlapping these inverted-L-shaped antenna patterns 52 and 53 each other by way of the printed circuit board 1, the frequency bandwidth of the inverted-L-shaped antenna patterns 52 and 53 is widened, compared with when constructed as in FIG. 1.

In this embodiment, another inverted-L-shaped antenna pattern is so constructed on the reverse-side surface as to overlap the inverted-L-shaped antenna pattern on the obverse-side surface the pattern antenna constructed in the same manner as the construction shown in FIG. 1. However, an inverted-F-shaped antenna pattern may be so formed on the reverse-side surface as to overlap the inverted-F-shaped antenna pattern on the obverse-side surface. Also, at least one of the antenna patterns may be so formed on the reverse side as to overlap an antenna pattern on the obverse-side surface of a pattern antenna having the configuration as shown in FIG. 1 or FIGS. 3 through 7 or FIGS. 10 through 15.

<Seventh Embodiment>

Figure 17A:
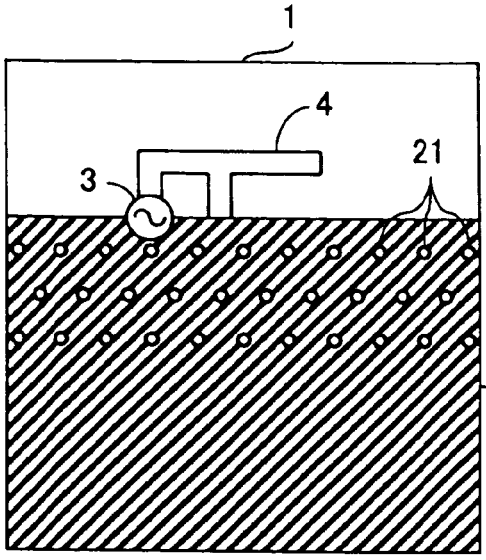
Figure 17A:
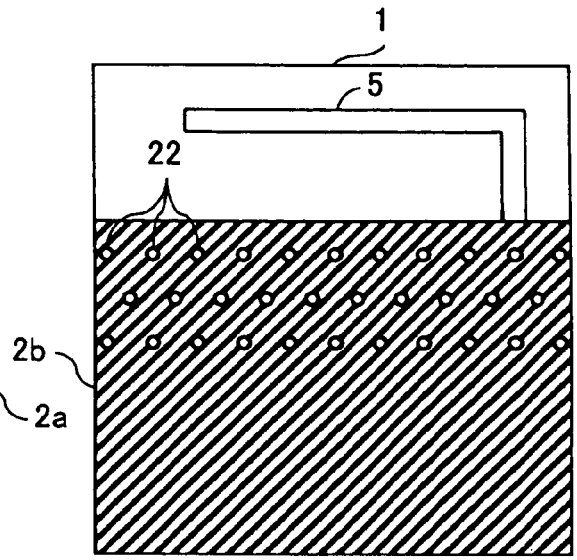

A seventh embodiment of the invention will be described below with reference to the drawings. FIGS. 17A and 17B are diagrams showing the obverse-side surface and the reverse-side surface of the pattern antenna of this embodiment respectively. Here, such elements as are used for the same purposes as in the pattern antenna of the first embodiment are identified with the same reference numerals, and their detailed explanations will not be repeated.

The pattern antenna of this embodiment is composed of the inverted-F-shaped antenna pattern 4 and a ground pattern 2*a* that are formed by a metal foil on a surface of the printed circuit board 1 shown in FIG. 17A; and the inverted-L-shaped antenna pattern 5 and a ground pattern 2*b* that are formed on the reverse-side surface of the printed circuit board 1 shown in FIG. 17B. Namely, the pattern antenna of this embodiment is so configured as to have the same construction of the pattern antenna shown in FIG. 16A and FIG. 16B, but the inverted-L-shaped antenna pattern 52 is excluded from the construction.

With the construction as described above, the inverted-F-shaped antenna pattern 4 and the inverted-L-shaped antenna pattern 5 are not formed on the same surface but are insulated by the printed circuit board 1. As a result, their locations can be adjusted in the direction in parallel with the surface of the printed circuit board. By constructing the antenna patterns 4 and 5 in this way, it is possible to adjust their positional relation. Therefore, compared with the pattern antenna in FIG. 1, impedance of the antenna can be adjusted in a wider range.

In this embodiment, the antenna patterns having a construction shown in FIG. 1 that are formed on the same surfaces are formed on the different surfaces. However, each of the antenna patterns formed in configuration as shown in FIG. 1 or FIGS. 3 through 7 or FIGS. 10 through 15 may be formed on different surfaces.

<Eighth Embodiment>

An eighth embodiment of the invention will be described below with reference to the drawings. FIGS. 18A through 18D are diagrams showing the obverse-side surface and the interface surface of the pattern antenna of this embodiment. Here, such elements as are used for the same purposes as in the pattern antenna of the seventh embodiment are identified with the same reference numerals, and their detailed explanations will not be repeated.

Figure 18A:
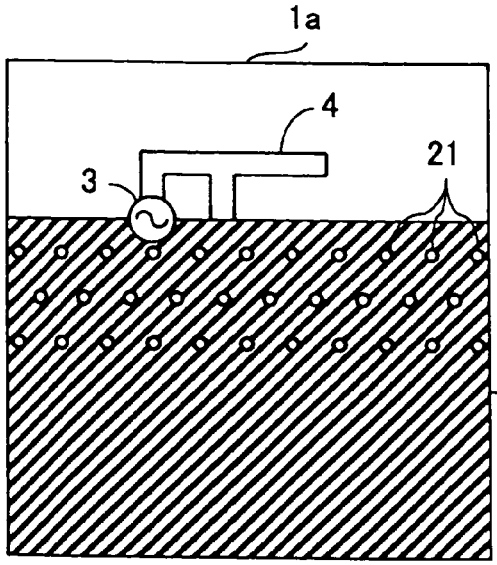
FIG. 18A through FIG. 18D are diagrams showing the configurations of the pattern antenna of an eighth embodiment of the invention.
Figure 18C:
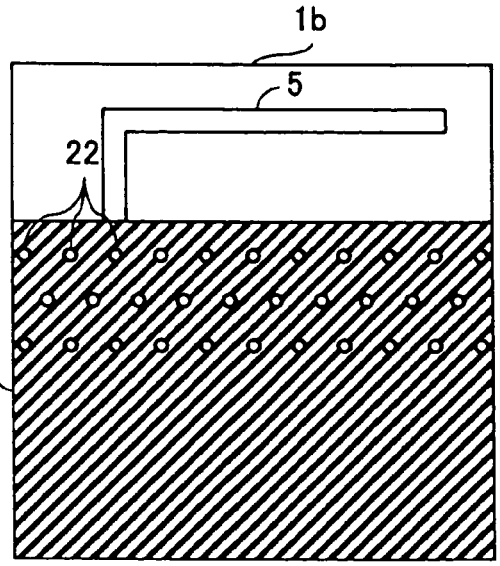
Figure 18B:
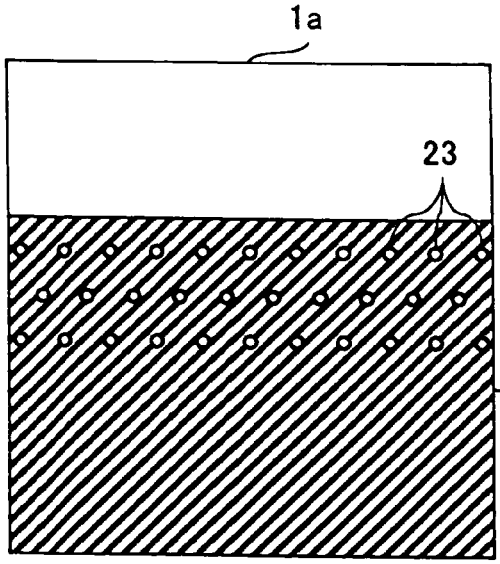
Figure 18D:
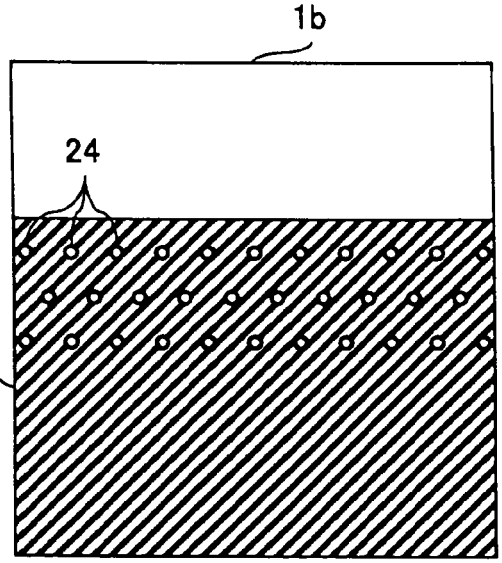

The pattern antenna of this embodiment is composed of four layers of a printed circuit board consisting of printed circuit boards 1*a* and 1*b*, and includes the inverted-F-shaped antenna pattern 4 and a ground pattern 2*a* that are formed by a metal foil on a surface of the printed circuit board 1*a* shown in FIG. 18A and a ground pattern 2*c* which is formed by a metal foil on a surface of the printed circuit board 1*a* shown in FIG. 18B, facing to the printed circuit board 1*b*; and the inverted-L-shaped antenna pattern 5 and the ground pattern 2*b* that are formed by a metal foil on a surface of the printed circuit board 1*b* shown in FIG. 18C, facing to the printed circuit board la; and the ground pattern 2*d* which is formed by a metal foil on a surface of the printed circuit board 1*b* shown in FIG. 18D. By making the through holes 21 through 24 into the ground patterns 2*a* through 2*d* respectively, the ground patterns 2*a* through 2*d* are electrically connected. Although not indicated in FIGS. 18A through 18D, an insulation layer is formed between the ground patterns 2*b* and 2*c*.

With this configuration as above mentioned, the inverted-F-shaped antenna pattern 4 and the inverted-L-shaped antenna pattern 5 are not formed on the same surface but are insulated by the printed circuit board 1*a*, so that it is possible to adjust their locations respectively in the direction in parallel with the surface of the printed circuit board. As a result, in the same manner as the pattern antennas shown in FIGS. 17A and 17B, impedance of antennas can be adjusted in a wider range, compared with the pattern antenna in FIG. 1. Additionally, since the inverted-L-shaped antenna pattern 5 is sandwiched between the printed circuit boards 1*a* and 1*b* and thus is located inside a dielectric substance, its path length can be shortened.

In this embodiment, each of antenna patterns that are formed on the same surface in a configuration as shown in FIG. 1 is formed on a different layer which is a layer corresponding to a surface or an interface, both of which are inside a circuit board consisting of a plurality of layers. However, each of the antenna patterns that are so formed in a configuration as shown in FIG. 1 or FIGS. 3 through 7 or FIGS. 10 through 15 may be formed on a different layer which is a layer corresponding to a surface or an interface, both of which are inside a circuit board consisting of a plurality of layers. Moreover, in this embodiment, four layers of printed circuit boards constitute a printed circuit board. However, a printed circuit board may be composed of any other number of layers than four.

<Ninth Embodiment>

Figures 19A, 19B:
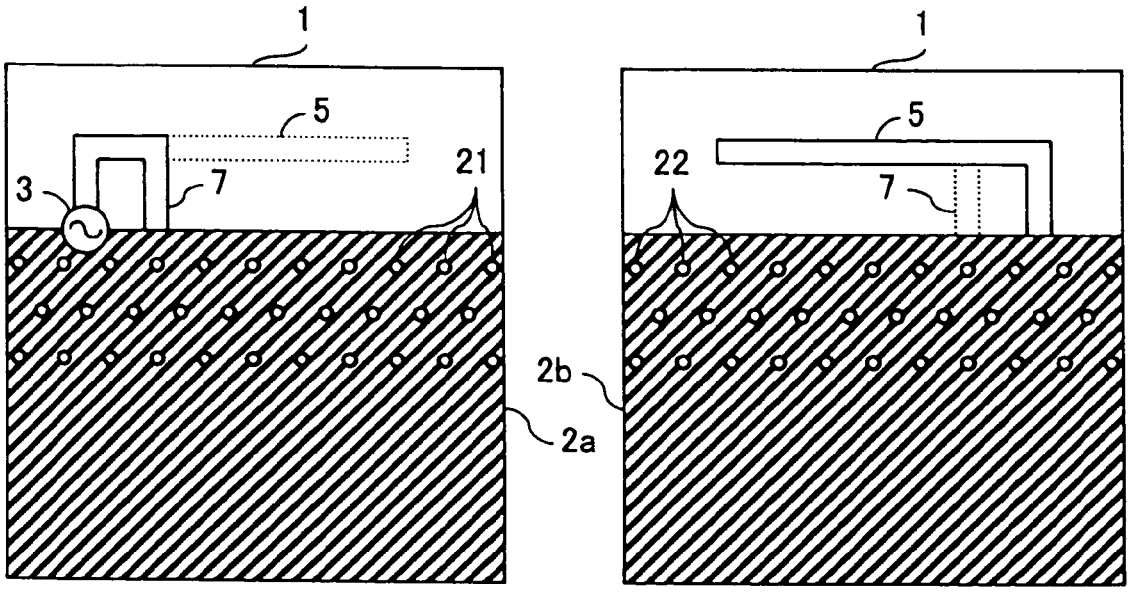
FIG. 19A and FIG. 19B are diagrams showing the configurations of the pattern antenna of a ninth embodiment of the invention.

A ninth embodiment of the invention will be described below with reference to the drawings. FIG. 19A and FIG. 19B are diagrams showing the obverse-side and the reverse-side surfaces of the pattern antenna of this embodiment respectively. Here, such elements as are used for the same purposes as in the pattern antennas of the third and the seventh embodiments are identified with the same reference numerals, and their detailed explanations will not be repeated.

The pattern antenna of this embodiment is composed of a loop-type antenna pattern 7 and a ground pattern 2*a* that are formed by a metal foil on a surface of the printed circuit board 1 shown in FIG. 19A; and an inverted-L-shaped antenna pattern 5 and a ground pattern 2*b* that are formed on the reverse-side of the printed circuit board 1 shown in FIG. 19B. Here, different from the pattern antenna of the seventh embodiment, the elongate pattern 5*a* and the conductor pattern 5*b* of the inverted-L-shaped antenna pattern 5 and the elongate pattern 7*a* and the conductor pattern 7*b* of the loop-type antenna pattern 7 are installed, overlapping each other with the printed circuit board 1 sandwiched in between.

With this construction as described above, the inverted-L-shaped antenna pattern 5 and the loop-type antenna pattern 7 are not formed on the same surface but isolated by the printed circuit board 1, and as a result, their locations can be adjusted in a direction in parallel with a surface of the printed circuit board. Forming the antenna patterns in this way makes it possible to adjust the positional relation of the antenna patterns, so that compared with the pattern antenna of the third embodiment, impedance of the antenna can be adjusted in a wider range. Here, by setting the length, the conductor width and the height of the inverted-L-shaped antenna pattern 5 and the length and the conductor width of the loop-type antenna pattern 7 in the same manner as the third embodiment and by setting the space between the inverted-L-shaped antenna pattern 5 and the loop-type antenna pattern 7 that is determined by the printed circuit board 1 in the same manner as the space Wr1 between the inverted-L-shaped antenna pattern 5 and the loop-type antenna pattern 7 in the third embodiment, more than 100% bandwidth to center frequency ratio can be achieved.

In this embodiment, the pattern antenna has the inverted-L-shaped antenna pattern and the loop-type antenna pattern formed on the observe-side surface and the reverse-side surface of the printed circuit board respectively. However, same as the eighth embodiment, a pattern antenna may be so constructed as to have an inverted-L-shaped antenna pattern and a loop type antenna pattern overlap each other on different layers of the printed circuit board consisting of a plurality of layers.

<Tenth Embodiment>

Figure 20A:
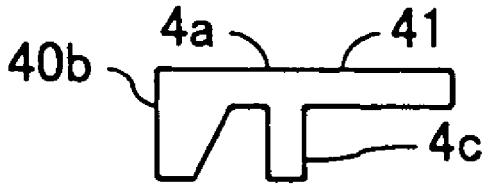
FIG. 20A through FIG. 20C are diagrams showing the configurations of the pattern antenna of a tenth embodiment of the invention.
Figure 20B:
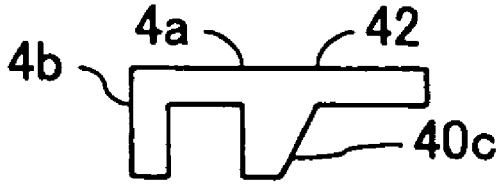
Figure 20C:
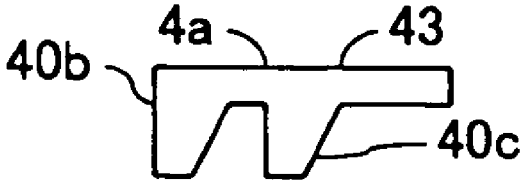

A tenth embodiment of the invention will be described below with reference to the drawings. FIGS. 20A through 20C are diagrams showing the construction of antenna patterns included the pattern antenna of this embodiment. Here, this embodiment will be explained by employing an inverted-F-shaped antenna pattern constituting the pattern antenna in FIG. 1 as an example.

In this embodiment, as the inverted-F-shaped antenna pattern 41 shown in FIG. 20A, a tapered conductor pattern 40*b* corresponding to the conductor pattern 4*b* may be formed; or as the inverted-F-shaped antenna pattern 42 shown in FIG. 20B, a tapered conductor pattern 40*c* corresponding to the conductor pattern 4*c* may be formed; or as the inverted-F-shaped antenna pattern 43 shown in FIG. 20*c*, the tapered conductor patterns 40*b* and 40*c* corresponding to the conductor patterns 4*b* and 4*c* respectively may be formed. Here, the tapered conductor patterns 40*b* and 40*c* are so shaped as to spread in a manner that they are wide on the side of the elongate pattern 4*a* thereof.

By including at least one of the tapered conductor patterns 40*b* and 40*c* in this way, the inverted-F-shaped antenna patterns 41 through 43 can change the inner-side path length and the outer-side path length thereof. Therefore, the inverted-F-shaped antenna patterns 41 through 43 in FIGS. 20A through 20C can widen the usable frequency bandwidth, compared with the inverted-F-shaped antenna pattern 4 in FIG. 1

This embodiment has been described, taking an inverted-F-shaped antenna pattern as an example. In the first through the ninth embodiments, the conductor patterns included the inverted-L-shaped antenna pattern and the loop-type antenna pattern may be tapered in the same manner as the conductor patterns of the inverted-F-shaped antenna patterns shown in FIGS. 20A through 20C. Also, an inverted-F-shaped antenna pattern provided with a tapered conductor pattern and/or an inverted-L-shaped antenna pattern provided with a tapered conductor pattern and/or a loop-type antenna pattern provided with a tapered conductor pattern may be combined as the above-mentioned first through ninth embodiments. Moreover, in this embodiment, the conductor pattern is tapered, and the elongate pattern may also be tapered.

<Eleventh Embodiment>

Figure 21A:
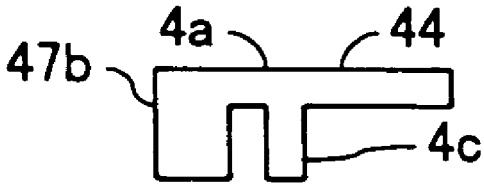
FIG. 21A through FIG. 21C are diagrams showing the configurations of the pattern antenna of an eleventh embodiment of the invention.
Figure 21B:
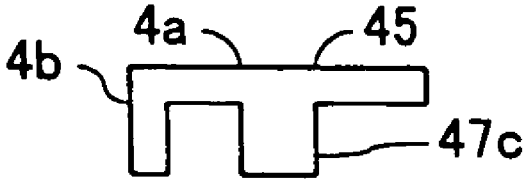
Figure 21C:
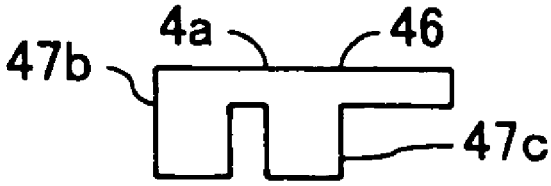

An eleventh embodiment of the invention will be described below with reference to the drawings. FIGS. 21A through 21C are diagrams showing the construction of antenna patterns included the pattern antenna of this embodiment. Here, this embodiment will be explained by using an inverted-F-shaped antenna pattern constituting the pattern antenna in FIG. 1 as an example.

In this embodiment, as the inverted-F-shaped antenna pattern 44 shown in FIG. 21A, it is possible to mount a conductor pattern 47*b* that corresponds to the conductor pattern 4*b* and has a wider conductor width than the elongate pattern 4*a* and a conductor pattern 4*c*; or as the inverted-F-shaped antenna pattern 45 shown in FIG. 21B, it is possible to mount a conductor pattern 47*c* that corresponds to the conductor pattern 4*c* and has a wider conductor width than the elongate pattern 4*a* and a conductor pattern 4*b*; or as the inverted-F-shaped antenna pattern 46 shown in FIG. 21C, it is possible to mount conductor patterns 47*b* and 47*c* that correspond to the conductor patterns 4*b* and 4*c* respectively and have a wider conductor width than the elongate pattern 4*a*.

As mentioned above, by including at least one of the conductor patterns 47*b* and 47*c* whose conductor width is wider than that of the other patterns included an antenna pattern, the inverted-F-shaped antenna patterns 44 through 46 can change the inner-side path length and the outer-side path length thereof. Therefore, the inverted-F-shaped antenna patterns 44 through 46 in FIGS. 21A through 21C can make the usable frequency bandwidth wider, compared with the inverted-F-shaped antenna pattern 4 in FIG. 1.

In this embodiment, an inverted-F-shaped antenna pattern has been employed as an example for description. However, in the first through the ninth embodiments, the conductor patterns included the inverted-L-shaped antenna pattern and/or the loop-type antenna pattern may have a wider conductor width than the other patterns in the same manner as the conductor patterns of the inverted-F-shaped antenna pattern in FIGS. 21A through 21C. Additionally, each of an inverted-F-shaped antenna pattern, an inverted-L-shaped antenna pattern and a loop-type antenna pattern, that are provided with a conductor pattern having a wider width than the other patterns, may be combined as the above first through the ninth embodiments.

<Twelfth Embodiment>

Figure 22:
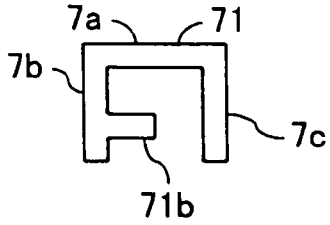
FIG. 22 is a diagram showing the configuration of the pattern antenna of a twelfth embodiment of the invention.

A twelfth embodiment of the invention will be described below with reference to the drawings. FIG. 22 is a diagram showing the construction of the loop-type antenna pattern constituting the pattern antenna of this embodiment. Here, such elements as are used for the same purposes as in the pattern antenna of the third embodiment are identified with the same reference numerals, and their detailed explanations will not be repeated.

In this embodiment, as a loop-type antenna pattern 71 shown in FIG. 22, a branch-shaped stub pattern 71*b* is formed, starting at one point between both edges of the conductor pattern 7*b*. This stub pattern 71*b* is so formed as to be in parallel with the ground pattern 2 and located in close proximity to the feeding point 3. By providing a stub pattern 71*b* to the loop-type antenna pattern 71 in this way, impedance can be adjusted. Therefore, the antenna pattern 71 in FIG. 22 can make the usable frequency bandwidth wider, compared with the loop-type antenna pattern 7 of the third embodiment.

Figure 23:
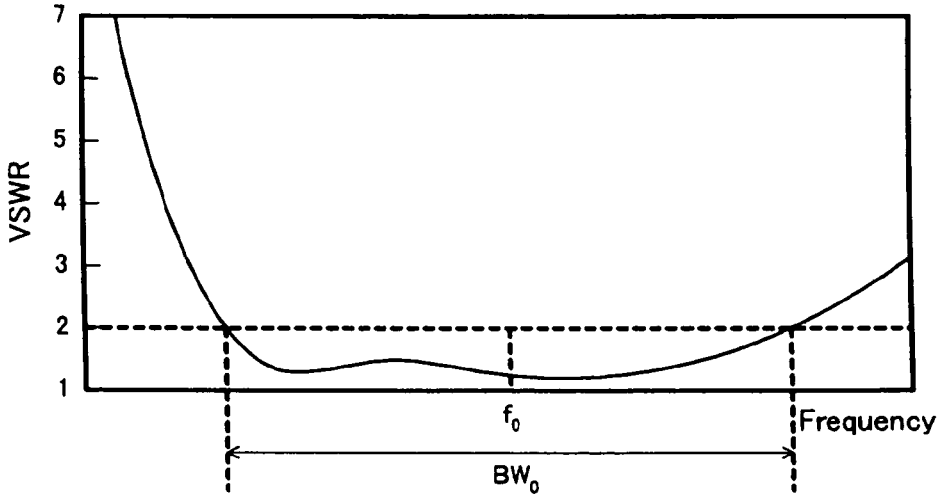
FIG. 23 is a graphic chart showing the frequency response of the voltage standing wave ratio (VSWR) of the pattern antenna of FIG. 22.

Accordingly, when the length and the conductor width of the loop-type antenna pattern 71, the length, the conductor width and the height of the inverted-L-shaped antenna pattern 5 and the space between the loop-type antenna pattern 71 and the inverted-L-shaped antenna pattern 5 are set to be the same as the third embodiment, the frequency response of the voltage standing wave ratio (VSWR) of the pattern antenna is to be as shown in FIG. 23. Namely, when it is compared with the frequency response of the VSWR of the pattern antenna of the third embodiment (FIG. 9), the value of the VSWR between two resonance frequencies can be lowered, and thus the VSWR value in the frequency bandwidth where the VSWR is less than 2 can be improved.

Figure 24A:
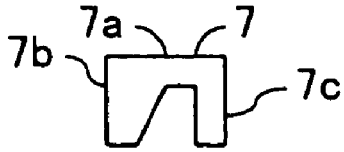
FIG. 24A through FIG. 24F are diagrams showing other configurations of the pattern antenna of the twelfth embodiment of the invention.
Figure 24B:
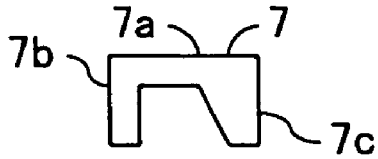
Figure 24C:
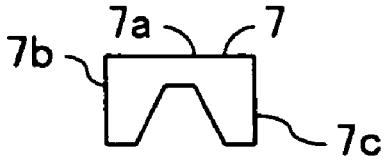
Figure 24D:
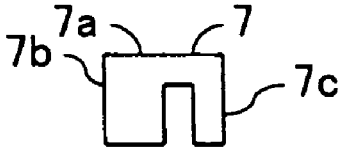
Figure 24E:
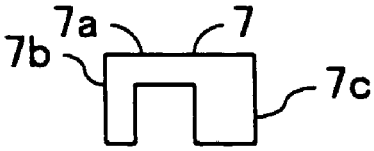
Figure 24F:
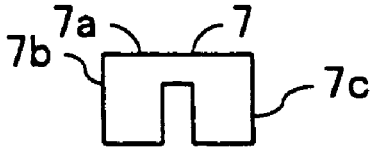

In this embodiment, the loop-type antenna pattern is so formed as to have a stub pattern installed to the conductor pattern which is connected to the feeding point. However, a stub pattern may be installed to an elongate pattern or to a conductor pattern which is connected to the ground pattern. Additionally, as FIGS. 24A through 24C, the conductor patterns 7*b* and 7*c* may be tapered in the same manner as the tenth embodiment. Moreover, as FIGS. 24D through 24F, like the eleventh embodiment, the conductor patterns 7*b* and 7*c* may have the conductor width thereof wider than the conductor width of the elongate pattern 7*a*.

Although constructed as mentioned above, by setting the length and the conductor width of the loop-type antenna pattern, the length, the conductor width and the height of the inverted-L-shaped antenna pattern and the space between the loop-type antenna pattern and the inverted-L-shaped antenna pattern to be the same as the third embodiment, the frequency response of the voltage standing wave ratio of the pattern antenna can be adjusted to be more favorable than the third embodiment.

<Thirteenth Embodiment>

A thirteenth embodiment of the invention will be described below with reference to the drawings. FIGS. 25A through 25D are diagrams showing the construction of the antenna patterns included the pattern antenna of this embodiment. Here, this embodiment will be explained by employing an inverted-L-shaped antenna pattern constituting the pattern antenna in FIG. 1 as an example.

Figure 25A:
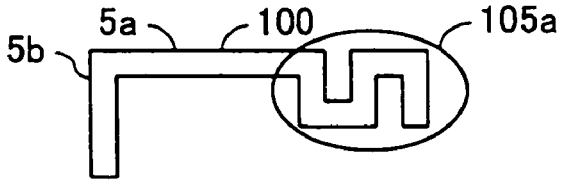
FIG. 25A through FIG. 25D are diagrams showing the configurations of the pattern antenna of a thirteenth embodiment of the invention.
Figure 25B:
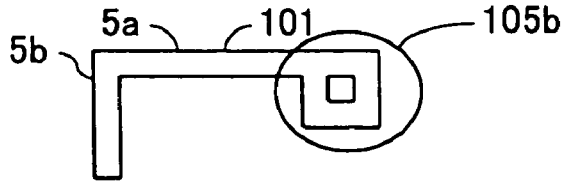
Figure 25C:
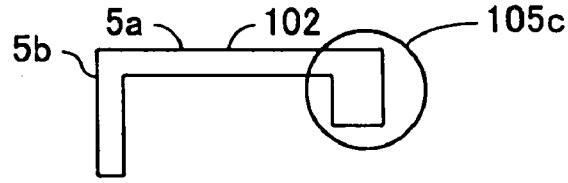
Figure 25D:
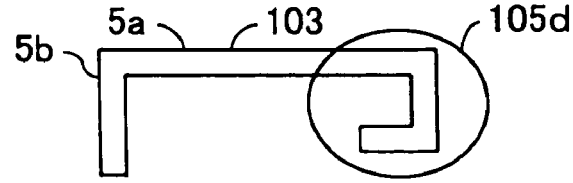

In this embodiment, as the inverted-L-shaped antenna pattern 100 shown in FIG. 25A, it is possible to provide a meandering pattern 105*a* on the side of the open end of the elongate pattern 5*a*; or as the inverted-L-shaped antenna pattern 101 shown in FIG. 25B, a loop-type pattern 105*b* may be formed on the side of the open end of the elongate pattern 5*a*; or as the inverted-L-shaped antenna pattern 102 shown in FIG. 25C, it is possible to have a patch-shaped pattern 105*c* formed to have a wide conductor width on the side of the open end of the elongate pattern 5*a*; or as the inverted-L-shaped antenna pattern 103 shown in FIG. 25D, it is also possible to have a bending pattern 105*d* formed on the side of the open end of the elongate pattern 5*a*.

By forming the meandering pattern 105*a* or the bending pattern 105*d* on the side of the open end of the elongate pattern 5*a* in this way, it is possible to make the occupied area of the inverted-L-shaped antenna patterns 100 and 103 smaller than the inverted-L-shaped antenna pattern 5 in FIG. 1, and thereby a laminate antenna pattern can be miniaturized. Moreover, by forming a loop-type pattern 105*b* and a patch-shaped pattern 105*c* on the side of the open end of the elongate pattern 5*a*, it is possible to make the width of the frequency bandwidths of the inverted-L-shaped antenna patterns 101 and 102 wider than the inverted-L-shaped antenna pattern 5 in FIG. 1.

In this embodiment, an inverted-L-shaped antenna pattern has been taken as an example for explanation. However, in the first through the ninth embodiments, the conductor patterns constituting the inverted-F-shaped antenna pattern may have a meandering pattern, a loop-type pattern, a patch-shaped pattern or a bending pattern formed on the side of the open end thereof in the same manner as the elongate pattern of the inverted-L-shaped antenna pattern in FIGS. 25A through 25D. Moreover, an inverted-F-shaped antenna pattern and an inverted-L-shaped antenna pattern both of which have any of the above-mentioned patterns including a meandering pattern, a loop-type pattern, a patch-shaped pattern and bending pattern on the side of the open end of the elongate pattern may be combined as the above-mentioned first through the ninth embodiments. Moreover, the meandering pattern may be formed not only on the side of the open end of the elongate pattern but also it may be formed on a part or on the whole of the elongate pattern or the conductor pattern, or it may be applied to a loop-type antenna pattern.

<Fourteenth Embodiment>

Figure 26A:
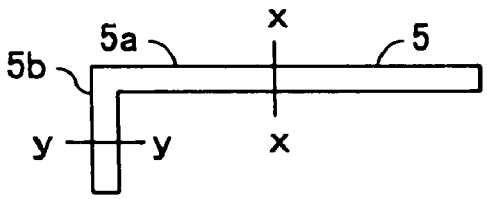
FIG. 26A and FIG. 26B are diagrams showing the configurations of the pattern antenna of a fourteenth embodiment of the invention.
Figure 26B:
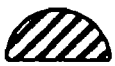

A fourteenth embodiment of the invention will be described below with reference to the drawings. FIGS. 26A and 26B are diagrams showing the construction of the antenna patterns included the pattern antenna of this embodiment. Here, this embodiment will be explained by using an inverted-L-shaped antenna pattern constituting the pattern antenna in FIG. 1 as an example.

In this embodiment, in the inverted-L-shaped antenna pattern 5 shown in FIG. 26A, only the elongate pattern 5*a* may have a solder laid thereon, so that the sectional view taken along the line x—x of the elongate pattern 5*a* is to be as shown in FIG. 26B; or only the conductor pattern may have a solder laid thereon, so that the sectional view taken along the line y—y of the conductor pattern 5*b* is to be as shown in FIG. 26B. Moreover, both the elongate pattern 5*a* and the conductor pattern 5*b* may have a solder laid thereon.

As the inverted-L-shaped antenna pattern described in this embodiment, the whole or a part of antenna patterns of the inverted-F-shaped antenna patterns, the inverted-L-shaped antenna patterns and the loop-type antenna patterns described in the first through the thirteenth embodiments may have a solder laid thereon. Furthermore, a part of the patterns constituting each antenna pattern may have a solder laid thereon. By soldering in this way, antennas can achieve a cubic content and can widen the width of the frequency bandwidth thereof.

Figure 27:
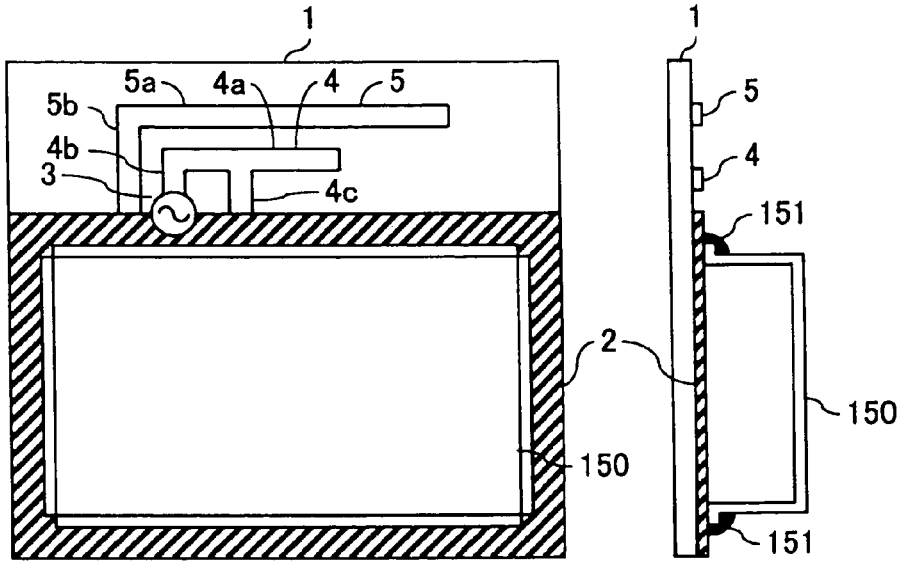
FIG. 27 is a diagram showing the construction of a printed circuit board equipped with the pattern antenna of the present invention.

When the pattern antennas of the above first through the fourteenth embodiments are provided, as shown in FIG. 27, a shield board 150 composed of metal may be so formed on the printed circuit board 1, for example, where a pattern antenna is formed by the inverted-F-shaped antenna pattern 4 and the inverted-L-shaped antenna pattern 5, as to cover a circuit element mounted on the ground pattern 2. This shield board 150 is to be of a size sufficient enough to be in close proximity to the edge of circumference of the ground pattern 2, and the circumference thereof is soldered to the ground pattern 2 by the solder 151. Thus, the shield board 150 installed in this way can shield the circuit element mounted on the printed circuit board 1 from electric waves.

Additionally, in case where the ground pattern 2 on the printed circuit board 1 is divided into pieces or narrowed by the portion where the circuit element is mounted, it is possible to enhance grounding effect because the grounding area is increased by the shield board 150. When it is difficult to solder the shield board 150, the ground pattern 2 on the printed circuit board 1 and the shield board 150 may be electrically connected by a metal spring which is soldered near the edge of the circumference of the ground pattern 2 on the printed circuit board 1. Especially, it is effective to connect the ground pattern 2 at an edge of the circumference thereof to the shield board 150 around the edge where an antenna exists.

Figure 28:
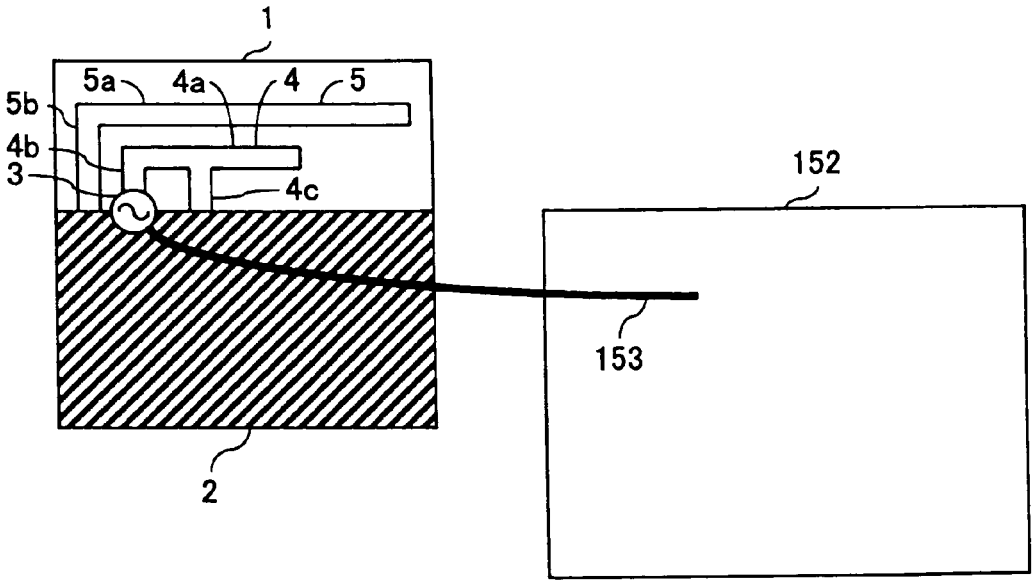
FIG. 28 is a diagram showing the construction of a printed circuit equipped with the pattern antenna of the present invention when it is formed as a different thing from a printed circuit board for circuitry.

As shown in FIG. 28, the printed circuit board 1 where a pattern antenna is provided and a printed circuit board for circuitry 152 where a circuit element is mounted may be different printed circuit boards and be connected to each other by way of a coaxial cable 153. In FIG. 28, an example is indicated by using a pattern antenna composed of the inverted-F-shaped antenna pattern 4 and the inverted-L-shaped antenna pattern 5 of the first embodiment. In this way, it is possible to arrange a pattern antenna more freely.

Figure 29:
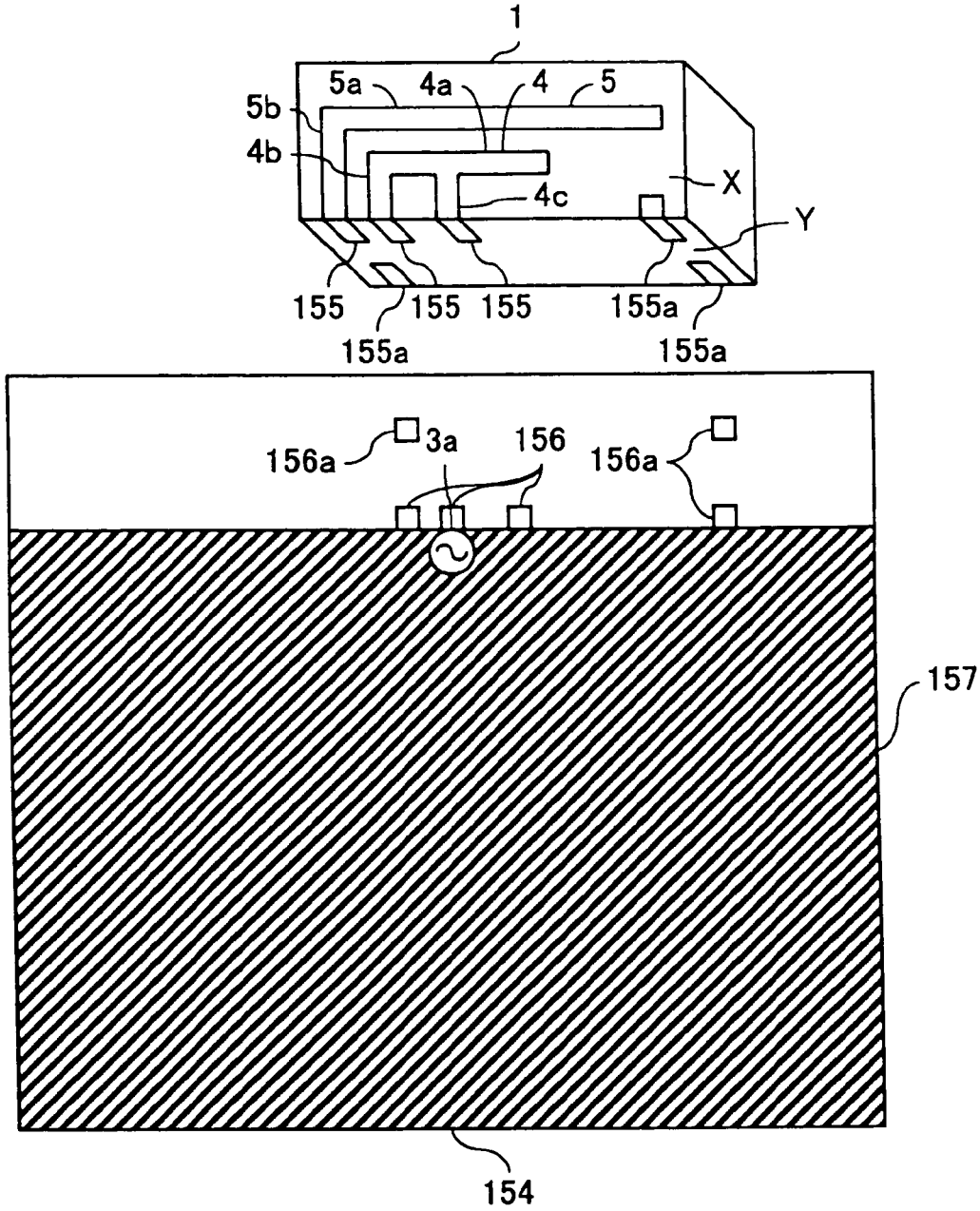
FIG. 29 is a diagram showing another construction of a printed circuit equipped with the pattern antenna of the present invention which is formed as different from a printed circuit board for circuitry.

As shown in FIG. 29, the printed circuit board 1 where a pattern antenna is provided may be a printed circuit board which is different from a printed circuit board for circuitry 154 where the circuit element is mounted, may have land patterns 155 and 155*a* formed on a face Y which is vertical to a face X where the pattern antenna is formed, and may have the land patterns 155 and 155*a* connected to land patterns 156 and 156*a* respectively that are mounted on the printed circuit board for circuitry 154. In FIG. 29, an example is given by employing a pattern antenna composed of the inverted-F-shaped antenna pattern 4 and the inverted-L-shaped antenna pattern 5 of the first embodiment, but they may constitute a pattern antenna of the second through fourteenth embodiments.

Here, the land pattern 155 is soldered to the land pattern 156, and the land pattern 155*a* is soldered to the land pattern 156*a*. In addition, the land pattern 155 is located at a position equivalent to the edges of the conductor patterns 4*b*, 4*c* and 5*b*, and the land pattern 155*a* plays an assistant role. Here, the printed circuit board 1 is thick.

By electrically connecting the land patterns 155 and 155*a* to the land patterns 156 and 156*a* in this way, the conductor pattern 4*b* is electrically connected to the feeding point 3*a* on the printed circuit board for circuitry 154 by way of the land patterns 155 and 156, and the conductor patterns 4*c* and 5*b* are electrically connected to the ground pattern 157 on the printed circuit board for circuitry 154 by way of the land patterns 155 and 156. Moreover, the land pattern 155*a* is electrically insulated.

Accordingly, with the construction as in FIG. 29, the antenna patterns constituting a pattern antenna are formed on the faces that are vertical to the printed circuit board for circuitry. As a result, it is possible to enhance the performance of transmission and reception of electric waves having surface of polarized waves that are vertical to the printed circuit board for circuitry, which the pattern antenna formed on the same surface as the printed circuit board for circuitry is relatively not good at.

Figure 30:
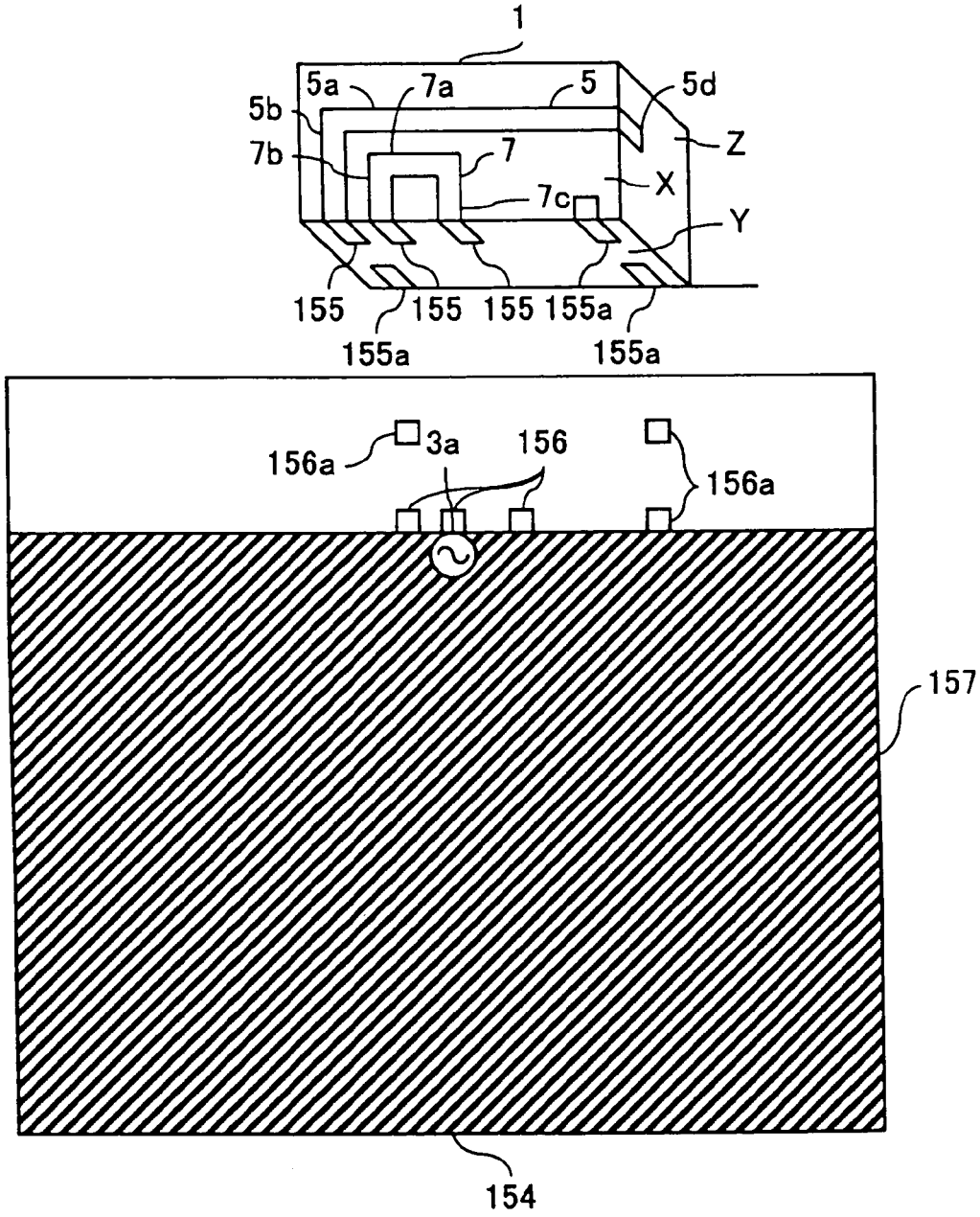
FIG. 30 is a diagram showing another construction of a printed circuit equipped with the pattern antenna of the present invention which is formed as different from a printed circuit board for circuitry.

Moreover, when the printed circuit board I which has a pattern antenna formed thereon is to be mounted on the printed circuit board for circuitry 154, as FIG. 30, the elongate pattern 5*a* of the inverted-L-shaped antenna pattern 5 may be formed onto a face Z which is vertical to a face X having the pattern antenna formed thereon and vertical to a face Y having the land patterns 155 and 155*a* formed thereon. In other words, the elongate pattern 5*a* has a pattern on the side of the conductor pattern 5*b* formed on the face X and also has a pattern on the side of the open end 5*d* formed on the face Z, so as to be formed on both of the faces X and Z of the printed circuit board 1. In this way, an antenna unit constructed by the printed circuit board 1 can be miniaturized, compared with the construction in FIG. 29. Moreover, in FIG. 30, is given an example of a pattern antenna composed of the inverted-L-shaped antenna pattern 5 and the loop-type antenna pattern 7 of the third embodiment. However, a pattern antenna of the first or the second or the fourth through fourteenth embodiments may be composed.

Figure 31:
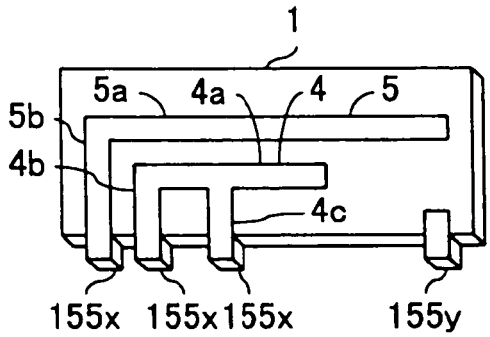
FIG. 31 is a diagram showing another construction of a printed circuit equipped with the pattern antenna of the present invention which is separate from a printed circuit board for circuitry.
Figure 31:
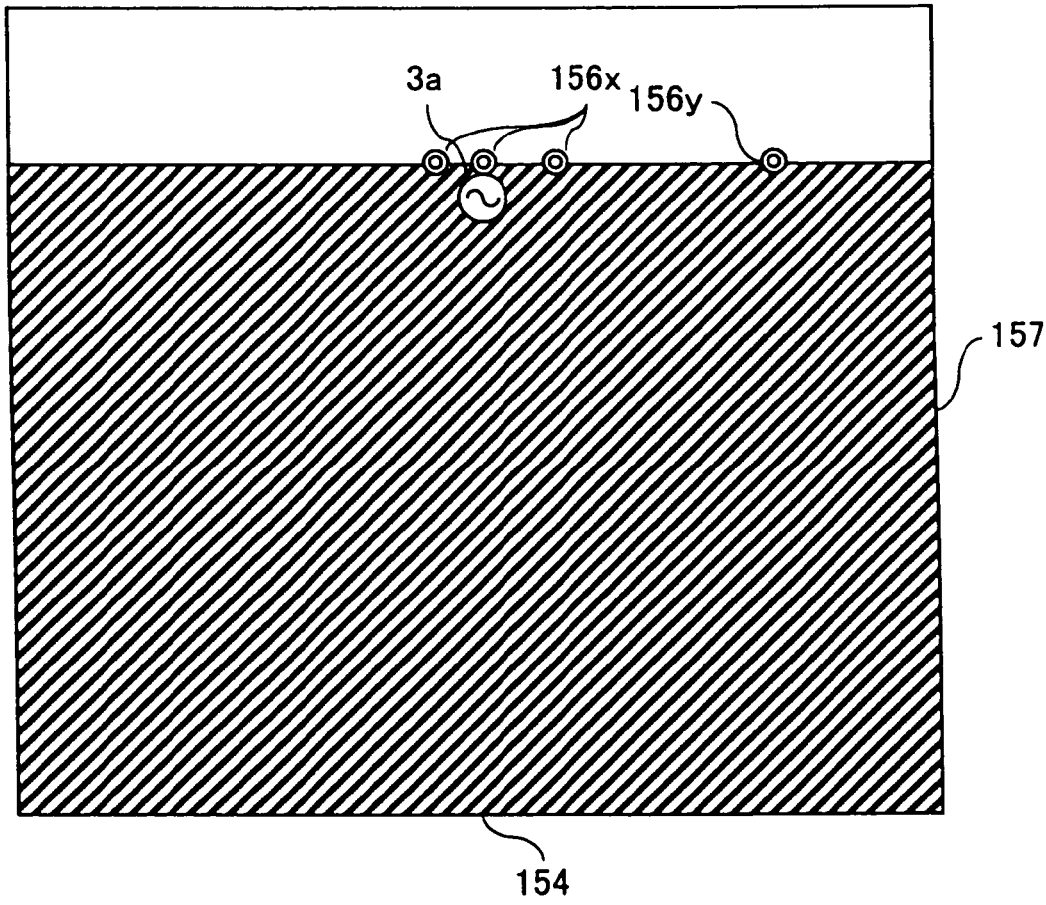

Moreover, as FIG. 31, the printed circuit board for circuitry 154 has a through hole 156*x* formed therein instead of the land pattern 156 which is electrically connected to the feeding point 3*a* and to the ground pattern 157, and has a through hole 156*y* made therein instead of the land pattern 156*a* which plays an assistant role to fix the printed circuit board 1. Here, for example, when the printed circuit board 1 has the inverted-F-shaped antenna pattern 4 and the inverted-L-shaped antenna pattern 5 mounted thereon as FIG. 29, it has a protruding electrode 155*x* mounted instead of the land pattern 155 which is electrically connected to the conductor patterns 4*b*, 4*c* and 5*b*, and also has a protruding electrode 155*y* mounted instead of the land pattern 155*a* which plays an assistant role to fix the printed circuit board 1.

By having the electrodes 155*x* and 155*y* and the through holes 156*x* and 156*y* mounted thereon, the electrodes 155*x* and 155*y* on the printed circuit board 1 are soldered after they are inserted into the through holes 156*x* and 156*y* in the printed circuit board for circuitry 154. Accordingly, the printed circuit board 1 is fixed to the printed circuit board for circuitry 154, and the conductor pattern 4*b* is electrically connected to the feeding point 3*a* on the printed circuit board for circuitry 154 by way of the electrode 155*x* and the through hole 156*x*; and the conductor patterns 4*c* and 5*b* are electrically connected to the ground pattern 157 of the printed circuit board for circuitry 154 by way of the electrode 155*x* and the through hole 156*x*. With the construction as mentioned above, multi-usability is enhanced and the printed circuit board 1 can be made thinner, compared with FIG. 29 or FIG. 30. Moreover, when constructed as FIG. 31, the pattern antenna of the second through the fourteenth embodiments may be composed.

The printed circuit board of the above-mentioned embodiments may be composed of glass-fiber-reinforced epoxy resin or ceramics or composed of other dielectric substance materials.

What is claimed is:

1. A pattern antenna comprising:

a first antenna pattern acting as a driven element and having an elongate pattern that is approximately in parallel with an edge of circumference of a grounding conductor portion provided on a circuit board; and a feeding pattern that connects a feeding point provided on the circuit board to the elongate pattern;

a second antenna pattern acting as a passive element, formed in close proximity to the first antenna pattern and having an elongate pattern that is approximately in parallel with the edge of circumference of the grounding conductor portion; and a grounding pattern that connects the grounding conductor portion to the elongate pattern;

wherein the pattern antenna is mounted on the circuit board, and wherein the elongate pattern of said first antenna pattern is closer to the grounding conductor portion than the elongate pattern of said second antenna pattern.

2. A pattern antenna as claimed in claim 1, wherein the first antenna pattern is an inverted-F-shaped antenna pattern, which is further provided with a grounding pattern that is formed at a different position from the feeding pattern, and which connects the grounding conductor portion to the elongate pattern, and wherein the second antenna pattern is an inverted-L-shaped antenna pattern.

3. A pattern antenna as claimed in claim 1, wherein the first antenna pattern is a loop-type antenna pattern, which is further provided with a grounding pattern that is formed at a different position from the feeding pattern, and which connects the grounding conductor portion to the elongate pattern, and wherein the second antenna pattern is an inverted-L-shaped antenna pattern.

4. A pattern antenna as claimed in claim 1, wherein both the first antenna pattern and the second antenna pattern are inverted-L-shaped antenna patterns.

5. A pattern antenna as claimed in claim 1, wherein, when frequencies for purpose of reception by the pattern antenna are f1 and f2 and wavelengths corresponding to the frequencies f1 and f2 are λ1 and λ2, a path length of the first antenna pattern is more than 0.1λ1 and 0.4λ1 or less, and a path length of the second antenna patter is more than 0.1λ2 and 0.4λ2 or less.

6. A pattern antenna as claimed in claim 1, wherein, when a center frequency of a frequency band for reception by the pattern antenna is f0 and a wavelength corresponding to the frequency f0 is λ0, a path length of the first antenna pattern is more than 0.3λ0 and 0.5λ0 or less, and a path length of the second antenna pattern is more than 0.4λ0 and 0.7λ0 or less.

7. A pattern antenna as claimed in claim 1, wherein, when a center frequency of a frequency band for reception by the pattern antenna is f0 and a wavelength corresponding to the frequency f0 is λ0, a conductor width of the first antenna pattern is more than 0.005λ0 and 0.05λ0 or less.

8. A pattern antenna as claimed in claim 1, wherein, when a center frequency of a frequency band for reception by the pattern antenna is f0 and a wavelength corresponding to the frequency f0 is λ0, a conductor width of the second antenna pattern is more than 0.005λ0 and 0.15λ0 or less.

9. A pattern antenna as claimed in claim 1, wherein, when a center frequency of a frequency band for reception by the pattern antenna is f0 and a wavelength corresponding to the frequency f0 is λ0, a space between the first antenna pattern and the second antenna pattern is more than 0.002λ0 and 0.04λ0 or less.

10. A pattern antenna as claimed in claim 1, wherein, when a center frequency of a frequency band for reception by the pattern antenna is f0 and a wavelength corresponding to the frequency f0 is λ0, a height from the grounding conductor portion to the top edge of the second antenna pattern is more than 0.1λ0 and 0.3λ0 or less.

11. A pattern antenna as claimed in claim 1, wherein a resonance frequency of the first antenna pattern differs from a resonance frequency of the second antenna pattern.

12. A pattern antenna as claimed in claim 1, further comprising:

at least one of third antenna patterns, that is installed in close proximity to other antenna patterns and is so formed as an inverted-L-shaped antenna pattern surrounding the other antenna patterns, having an elongate pattern approximately in parallel with the edge of circumference of the grounding conductor portion of the circuit board and a grounding pattern connecting the elongate pattern to the grounding conductor portion, and that acts as a passive element.

13. A pattern antenna as claimed in claim 12, wherein a resonance frequency of the third antenna pattern is approximately the same as a resonance frequency of the first antenna pattern or a resonance frequency of the second antenna pattern.

14. A pattern antenna as claimed in claim 12, wherein a resonance frequency of at least one of the third antenna patterns is different from resonance frequencies of the first and the second antenna patterns.

15. A pattern antenna as claimed in claim 1, wherein, when layers comprising the circuit board include a surface of the circuit board, all the antenna patterns are formed on a same layer of the circuit board.

16. A pattern antenna as claimed in claim 1, wherein, when layers comprising the circuit board include a surface of the circuit board, at least one of the antenna patterns is formed on a layer of the circuit board which is different from layers having the other antenna patterns formed thereon.

17. A pattern antenna as claimed in claim 1, further comprising:

at least one of fourth antenna patterns having a same shape as a part or a whole of one of the antenna patterns;

wherein, when layers comprising the circuit board include a surface of the circuit board, the fourth antenna pattern and the antenna patterns in the same shape as the fourth antenna pattern are formed on different layers and electrically connected to each other by way of through holes.

18. A pattern antenna as claimed in claim 1, wherein, in at least one of the antenna patterns, at least one of the patterns having the antenna pattern is tapered.

19. A pattern antenna as claimed in claim 1, wherein, in at least one of the antenna patterns, a conductor width of at least one of the patterns having the antenna pattern is different from the conductor width of the other patterns included the antenna pattern.

20. A pattern antenna as claimed in claim 1, wherein, in at least one of the antenna patterns, at least one of the patterns having the antenna pattern is provided with a branch-shaped stub pattern.

21. A pattern antenna as claimed in claim 20, wherein the stub pattern is provided in a neighborhood of the feeding point of the feeding pattern.

22. A pattern antenna as claimed in claim 20, wherein the stub pattern is provided at a position in close proximity to an antenna pattern which is in close proximity to the antenna pattern having the stub pattern formed.

23. A pattern antenna as claimed in claim 20, wherein the stub pattern is provided in parallel with the edge of circumference of the grounding conductor portion.

24. A pattern antenna as claimed in claim 23, wherein the stub pattern is provided in a neighborhood of the feeding point of the feeding pattern.

25. A pattern antenna as claimed in claim 1, wherein, in at least one of the antenna patterns, at least one of the patterns having the antenna pattern is partly or entirely formed in a meandering shape.

26. A pattern antenna as claimed in claim 1, wherein at least one of the elongate patterns of any of the antenna patterns is shaped in a loop at an open end thereof.

27. A pattern antenna as claimed in claim 1, wherein at least one of the elongate patterns of any of the antenna patterns is shaped in a patch which has a wider conductor width on an open end thereof.

28. A pattern antenna as claimed in claim 1, wherein at least one of the elongate patterns of any of the antenna patterns is bent on an open end thereof.

29. A pattern antenna as claimed in claim 1, wherein at least one of the antenna patterns is partly or entirely soldered.

30. A pattern antenna as claimed in claim 1, wherein a circuit element is mounted on the circuit board, and wherein a shield board covering the circuit element is provided on the grounding conductor portion.

31. A pattern antenna as claimed in claim 1, wherein the circuit board on which the antenna patterns are formed is an antenna circuit board, wherein a circuit element is mounted on a circuit element circuit board separate from the antenna circuit board, and wherein the antenna circuit board having the antenna patterns formed thereon is electrically connected to the circuit element circuit board by way of a coaxial cable.

32. A pattern antenna as claimed in claim 1, wherein the circuit board on which the antenna patterns are formed is an antenna circuit board, wherein a circuit element is mounted on a circuit element circuit board separate from the antenna circuit board, wherein the antenna circuit board having the antenna patterns formed thereon is provided with a first land pattern that is electrically connected to the grounding pattern and the feeding pattern, and wherein the circuit element circuit board is provided with a second land pattern that is connected to the first land pattern.

33. A pattern antenna as claimed in claim 32, wherein the antenna patterns are constructed on a plurality of surfaces of the circuit board.

34. A pattern antenna as claimed in claim 32, wherein the circuit board having the antenna patterns formed thereon has the first land pattern mounted on a surface thereof that is vertical to a surface having the antenna patterns formed thereon.

35. A pattern antenna as claimed in claim 1, wherein the circuit board on which the antenna patterns are formed is an antenna circuit board, wherein a circuit element is mounted on a circuit element circuit board separate from the antenna circuit board, wherein the antenna circuit board having the antenna patterns formed thereon is provided with a protruding electrode that is electrically connected to the grounding pattern and the feeding pattern of the antenna patterns, and wherein the circuit element circuit board has a through hole formed therethrough for the protruding electrode to be inserted into the through hole and electrically connected.

36. A pattern antenna as claimed in claim 35, wherein the antenna patterns are formed on a plurality of surfaces of the circuit board.

37. A pattern antenna comprising:

a first antenna pattern acting as a passive element, formed as a loop-type antenna pattern and having an elongate pattern that is approximately in parallel with an edge of circumference of a grounding conductor portion provided on a circuit board; and a pair of grounding patterns that connect the grounding conductor portion to the elongate pattern; and a second antenna pattern acting as a driven element formed as an inverted-L-shaped antenna pattern, formed in close proximity to the first antenna pattern and surrounding the first antenna pattern, and having an elongate pattern that is approximately in parallel with the edge of circumference of the grounding conductor portion and not having a connection to the grounding conductor portion; and a feeding pattern that connects a feeding point provided on the circuit board to the elongate pattern, wherein the pattern antenna is mounted on the circuit board.

38. A pattern antenna as claimed in claim 37, wherein the first antenna pattern is an inverted-F-shaped antenna pattern, which is further provided with a grounding pattern that is formed at a different position from the grounding pattern, and which connects the grounding conductor portion to the elongate pattern.

39. A pattern antenna as claimed in claim 37, wherein, when frequencies for purpose of reception by the pattern antenna are f1 and f2 and wavelengths corresponding to the frequencies f1 and f2 are $\lambda$1 and $\lambda$2, a path length of the first antenna pattern is more than 0.1$\lambda$1 and 0.4$\lambda$1 or less, and a path length of the second antenna pattern is more than 0.1$\lambda$2 and 0.4$\lambda$2 or less.

40. A pattern antenna as claimed in claim 37, wherein, when a center frequency of a frequency band for reception by the pattern antenna is f0 and a wavelength corresponding to the frequency f0 is λ0, a path length of the first antenna pattern is more than 0.3λ0 and 0.5λ0 or less, and a path length of the second antenna pattern is more than 0.4λ0 and 0.7λ0 or less.

41. A pattern antenna as claimed in claim 37, wherein, when a center frequency of a frequency band for reception by the pattern antenna is f0 and a wavelength corresponding to the frequency f0 is λ0, a conductor width of the first antenna pattern is more than 0.005λ0 and 0.05λ0 or less.

42. A pattern antenna as claimed in claim 37, wherein, when a center frequency of a frequency band for reception by the pattern antenna is f0 and a wavelength corresponding to the frequency f0 is λ0, a conductor width of the second antenna pattern is more than 0.005λ0 and 0.15λ0 or less.

43. A pattern antenna as claimed in claim 37, wherein, when a center frequency of a frequency band for reception by the pattern antenna is f0 and a wavelength corresponding to the frequency f0 is λ0, a space between the first antenna pattern and the second antenna pattern is more than 0.002λ0 and 0.04λ0 or less.

44. A pattern antenna as claimed in claim 37, wherein, when a center frequency of a frequency band for reception by the pattern antenna is f0 and a wavelength corresponding to the frequency f0 is λ0, a height from the grounding conductor portion to the top edge of the second antenna pattern is more than 0.1λ0 and 0.3λ0 or less.

45. A pattern antenna as claimed in claim 37, wherein a resonance frequency of the first antenna pattern differs from a resonance frequency of the second antenna pattern.

46. A pattern antenna as claimed in claim 37, further comprising:

at least one of third antenna patterns, that is installed in close proximity to other antenna patterns and is so formed as an inverted-L-shaped antenna pattern surrounding the other antenna patterns, having an elongate pattern approximately in parallel with the edge of circumference of the grounding conductor portion of the circuit board and a grounding pattern connecting the elongate pattern to the grounding conductor portion, and that acts as a passive element.

47. A pattern antenna as claimed in claim 46, wherein a resonance frequency of the third antenna pattern is approximately the same as a resonance frequency of the first antenna pattern or a resonance frequency of the second antenna pattern.

48. A pattern antenna as claimed in claim 46, wherein a resonance frequency of at least one of the third antenna patterns is different from resonance frequencies of the first and the second antenna patterns.

49. A pattern antenna as claimed in claim 37, wherein, when layers comprising the circuit board include a surface of the circuit board, all the antenna patterns are formed on a same layer of the circuit board.

50. A pattern antenna as claimed in claim 37, wherein, when layers comprising the circuit board include a surface of the circuit board, at least one of the antenna patterns is formed on a layer of the circuit board which is different from layers having the other antenna patterns formed thereon.

51. A pattern antenna as claimed in claim 37, further comprising:

at least one of fourth antenna patterns having a same shape as a part or a whole of one of the antenna patterns;

wherein, when layers having the circuit board include a surface of the circuit board, the fourth antenna pattern and the antenna patterns in the same shape as the fourth antenna pattern are formed on different layers and electrically connected to each other by way of through holes.

52. A pattern antenna as claimed in claim 37, wherein, in at least one of the antenna patterns, at least one of the patterns having the antenna pattern is tapered.

53. A pattern antenna as claimed in claim 37, wherein, in at least one of the antenna patterns, a conductor width of at least one of the patterns having the antenna pattern is different from the conductor width of the other patterns included the antenna pattern.

54. A pattern antenna as claimed in claim 37, wherein, in at least one of the antenna patterns, at least one of the patterns having the antenna pattern is provided with a branch-shaped stub pattern.

55. A pattern antenna as claimed in claim 54, wherein the stub pattern is provided in a neighborhood of the feeding point of the feeding pattern.

56. A pattern antenna as claimed in claim 54, wherein the stub pattern is provided at a position in close proximity to an antenna pattern which is in close proximity to the antenna pattern having the stub pattern formed.

57. A pattern antenna as claimed in claim 54, wherein the stub pattern is provided in parallel with the edge of circumference of the grounding conductor portion.

58. A pattern antenna as claimed in claim 57, wherein the stub pattern is provided in a neighborhood of the feeding point of the feeding pattern.

59. A pattern antenna as claimed in claim 37, wherein, in at least one of the antenna patterns, at least one of the patterns having the antenna pattern is partly or entirely formed in a meandering shape.

60. A pattern antenna as claimed in claim 37, wherein at least one of the elongate patterns of any of the antenna patterns is shaped in a loop at an open end thereof.

61. A pattern antenna as claimed in claim 37, wherein at least one of the elongate patterns of any of the antenna patterns is shaped in a patch which has a wider conductor width on an open end thereof.

62. A pattern antenna as claimed in claim 37, wherein at least one of the elongate patterns of any of the antenna patterns is bent on an open end thereof.

63. A pattern antenna as claimed in claim 37, wherein at least one of the antenna patterns is partly or entirely soldered.

64. A pattern antenna as claimed in claim 37, wherein a circuit element is mounted on the circuit board, and wherein a shield board covering the circuit element is provided on the grounding conductor portion.

65. A pattern antenna as claimed in claim 37, wherein the circuit board on which the antenna patterns are formed is an antenna circuit board, wherein a circuit element is mounted on a circuit element circuit board separate from the antenna circuit board, and wherein the antenna circuit board having the antenna patterns formed thereon is electrically connected to the circuit element circuit board by way of a coaxial cable.

66. A pattern antenna as claimed in claim 37, wherein the circuit board on which the antenna patterns are formed is an antenna circuit board, wherein a circuit element is mounted on a circuit element circuit board separate from the antenna circuit board, wherein the antenna circuit board having the antenna patterns formed thereon is provided with a first land pattern that is electrically connected to the grounding pattern and the feeding pattern, and wherein the circuit element circuit board is provided with a second land pattern that is connected to the first land pattern.

67. A pattern antenna as claimed in claim 66, wherein the antenna patterns are constructed on a plurality of surfaces of the circuit board.

68. A pattern antenna as claimed in claim 66, wherein the circuit board having the antenna patterns formed thereon has the first land pattern mounted on a surface thereof that is vertical to a surface having the antenna patterns formed thereon.

69. A pattern antenna as claimed in claim 37, wherein the circuit board on which the antenna patterns are formed is an antenna circuit board, wherein a circuit element is mounted on a circuit board separate from the antenna circuit board, wherein the antenna circuit board having the antenna patterns formed thereon is provided with a protruding electrode that is electrically connected to the grounding pattern and the feeding pattern of the antenna patterns, and wherein the circuit element circuit board has a through hole formed therethrough for the protruding electrode to be inserted into the through hole and electrically connected.

70. A pattern antenna as claimed in claim 69, wherein the antenna patterns are formed on a plurality of surfaces of the circuit board.

71. A pattern antenna comprising:

a first antenna pattern antenna which is a loop-type antenna pattern, provided with an elongate pattern that is approximately in parallel with an edge of circumference of a grounding conductor portion mounted on a circuit board; a feeding pattern that connects a feeding point provided on the circuit board to the elongate pattern; and a grounding pattern that connects the grounding conductor portion to the elongate pattern;

a second antenna pattern which is an inverted-L-shaped antenna pattern, provided with an elongate pattern that is approximately in parallel with the edge of circumference of the grounding conductor portion; and a grounding pattern that connects the grounding conductor portion to the elongate pattern;

wherein the circuit board consists of a plurality of layers including a surface of the circuit board;

wherein the first antenna pattern and the second antenna pattern are formed on different layers; and wherein the first antenna pattern and the second antenna pattern are so formed as to overlap each other.

72. A pattern antenna as claimed in claim 71, wherein, when a center frequency of a frequency band for reception by the pattern antenna is f0 and a wavelength corresponding to the frequency f0 is λ0, a path length of the first antenna pattern is more than 0.3λ0 and 0.5λ0 or less, and a path length of the second antenna pattern is more than 0.4λ0 and 0.7λ0 or less.

73. A pattern antenna as claimed in claim 71, wherein, when a center frequency of a frequency band for reception by the pattern antenna is f0 and a wavelength corresponding to the frequency f0 is λ0, a conductor width of the first antenna pattern is more than 0.005λ0 and 0.05λ0 or less.

74. A pattern antenna as claimed in claim 71, wherein, when a center frequency of a frequency band for reception by the pattern antenna is f0 and a wavelength corresponding to the frequency f0 is λ0, a conductor width of the second antenna pattern is more than 0.005λ0 and 0.15λ0 or less.

75. A pattern antenna as claimed in claim 71, wherein, when a center frequency of a frequency band for reception by the pattern antenna is f0 and a wavelength corresponding to the frequency f0 is λ0, a space between the first antenna pattern and the second antenna pattern is more than 0.002λ0 and 0.04λ0 or less.

76. A pattern antenna as claimed in claim 71, wherein, when a center frequency of a frequency band for reception by the pattern antenna is f0 and a wavelength corresponding to the frequency f0 is λ0, a height from the grounding conductor portion to the top end of the second antenna pattern is more than 0.1λ0 and 0.3λ0 or less.

77. A pattern antenna as claimed in claim 71, wherein a resonance frequency of the first antenna pattern differs from a resonance frequency of the second antenna pattern.

78. A pattern antenna as claimed in claim 71, further comprising:

at least one of third antenna patterns, that is installed in close proximity to other antenna patterns and is so formed as an inverted-L-shaped antenna pattern surrounding the other antenna patterns, having an elongate pattern approximately in parallel with an edge of circumference of a grounding conductor portion of the circuit board and a grounding pattern connecting the elongate pattern to the grounding conductor portion, and that acts as a passive element.

79. A pattern antenna as claimed in claim 78, wherein a resonance frequency of the third antenna pattern is approximately the same as a resonance frequency of the first antenna pattern or a resonance frequency of the second antenna pattern.

80. A pattern antenna as claimed in claim 78, wherein a resonance frequency of one of the third antenna patterns is different from resonance frequencies of the first and the second antenna patterns.

81. A pattern antenna as claimed in claim 71, further comprising:

at least one of fourth antenna patterns having a same shape as a part or a whole of one of the antenna patterns;

wherein the fourth antenna pattern and the antenna patterns in the same shape as the fourth antenna pattern are formed on different layers and electrically connected to each other by way of through holes.

82. A pattern antenna as claimed in claim 71, wherein, in at least one of the antenna patterns, at least one of the patterns having the antenna pattern is tapered.

83. A pattern antenna as claimed in claim 71, wherein, in at least one of the antenna patterns, a conductor width of at least one of the patterns having the antenna pattern is different from the conductor width of the other patterns having the antenna pattern.

84. A pattern antenna as claimed in claim 71, wherein, in at least one of the antenna patterns, at least one of the patterns having the antenna pattern is provided with a branch-shaped stub pattern.

85. A pattern antenna as claimed in claim 84, wherein the stub pattern is provided in a neighborhood of the feeding point of the feeding pattern.

86. A pattern antenna as claimed in claim 84, wherein the stub pattern is provided at a position in close proximity to an antenna pattern which is in close proximity to the antenna pattern having the stub pattern formed.

87. A pattern antenna as claimed in claim 84, wherein the stub pattern is provided in parallel with the edge of circumference of the grounding conductor portion.

88. A pattern antenna as claimed in claim 87, wherein the stub pattern is provided in a neighborhood of the feeding point of the feeding pattern.

89. A pattern antenna as claimed in claim 71, wherein, in at least one of the antenna patterns, at least one of the patterns having the antenna pattern is partly or entirely formed in a meandering shape.

90. A pattern antenna as claimed in claim 71, wherein at least one of the elongate patterns of any of the antenna patterns is shaped in a loop at an open end thereof.

91. A pattern antenna as claimed in claim 71, wherein at least one of the elongate patterns of any of the antenna patterns is shaped in a patch which has a wider conductor width on an open end thereof.

92. A pattern antenna as claimed in claim 71, wherein at least one of the elongate patterns of any of the antenna patterns is bent on an open end thereof.

93. A pattern antenna as claimed in claim 71, wherein at least one of the antenna patterns is partly or entirely soldered.

94. A pattern antenna as claimed in claim 71, wherein a circuit element is mounted on the circuit board, and wherein a shield board covering the circuit element is provided on the grounding conductor portion.

95. A pattern antenna as claimed in claim 71, wherein the circuit board on which the antenna pattern is formed is an antenna circuit board, wherein a circuit element is mounted on a circuit element circuit board separate from the antenna circuit board, and wherein the antenna circuit board having the antenna patterns formed thereon is electrically connected to the circuit element circuit board by way of a coaxial cable.

96. A pattern antenna as claimed in claim 71, wherein the circuit board on which the antenna pattern is formed is an antenna circuit board, wherein a circuit element is mounted on a circuit element circuit board separate from the antenna circuit board, wherein the antenna circuit board having the antenna patterns formed thereon is provided with a first land pattern that is electrically connected to the grounding pattern and the feeding pattern, and wherein the circuit element circuit board is provided with a second land pattern that is connected to the first land pattern.

97. A pattern antenna as claimed in claim 96, wherein the antenna patterns are constructed on a plurality of surfaces of the circuit board.

98. A pattern antenna as claimed in claim 96, wherein, the circuit board having the antenna patterns formed thereon has the first land pattern mounted on a surface thereof that is vertical to a surface having the antenna patterns formed thereon.

99. A pattern antenna as claimed in claim 96, wherein the circuit board on which the antenna pattern is formed is an antenna circuit board, wherein a circuit element is mounted on a circuit board separate from the antenna circuit board, wherein the antenna circuit board having the antenna patterns formed thereon is provided with a protruding electrode that is electrically connected to the grounding pattern and the feeding pattern of the antenna patterns, and wherein the circuit element circuit board has a through hole formed therethrough for the protruding electrode to be inserted into the through hole and electrically connected.

100. A pattern antenna as claimed in claim 99, wherein the antenna patterns are formed on a plurality of surfaces of the circuit board.

* * * * *